US011464342B2

(12) United States Patent
Snyder

(10) Patent No.: US 11,464,342 B2
(45) **Date of Patent: *Oct. 11, 2022**

(54) ADJUSTABLE LUMBAR SUPPORT AND ERGONOMIC CHAIR

(71) Applicant: Michael J Snyder, Newport Beach, CA (US)

(72) Inventor: Michael J Snyder, Newport Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/402,347

(22) Filed: Aug. 13, 2021

(65) Prior Publication Data

US 2021/0368989 A1 Dec. 2, 2021

Related U.S. Application Data

(63) Continuation of application No. 16/892,739, filed on Jun. 4, 2020, now Pat. No. 11,129,479.

(60) Provisional application No. 62/858,825, filed on Jun. 7, 2019.

(51) Int. Cl.

| | |
|---|---|
| ***A47C 1/16*** | (2006.01) |
| ***A47C 3/021*** | (2006.01) |
| ***A47C 3/026*** | (2006.01) |
| ***A47C 7/14*** | (2006.01) |
| ***A47C 7/18*** | (2006.01) |
| ***A47C 7/44*** | (2006.01) |
| ***A47C 7/46*** | (2006.01) |
| ***A47D 1/10*** | (2006.01) |
| ***A47C 7/48*** | (2006.01) |

(Continued)

(52) U.S. Cl.

CPC ..... *A47C 7/48* (2013.01); *A47C 7/14* (2013.01); *A47C 7/18* (2013.01); *A47C 7/402* (2013.01); *A47C 7/46* (2013.01); *A47C 11/005* (2013.01)

(58) Field of Classification Search

CPC .... A47C 3/04; A47C 7/14; A47C 7/18; A47C 7/402; A47C 7/46; A47C 7/48; A47C 11/005

USPC .... 297/252, 284, 4, 284.7, 285, 352, 452.37

See application file for complete search history.

(56) References Cited

U.S. PATENT DOCUMENTS

| | | | |
|---|---|---|---|
| 3,938,858 | A | 2/1976 | Drabert |
| 4,032,190 | A | 6/1977 | Muller-deisig |
| 4,097,087 | A | 6/1978 | Garavaglia |

(Continued)

FOREIGN PATENT DOCUMENTS

| | | | |
|---|---|---|---|
| DE | 19848400 | A1 | 5/2000 |
| WO | WO2016053321 | A1 | 4/2016 |

*Primary Examiner* — Rodney B White

(74) *Attorney, Agent, or Firm* — Guy Cumberbatch

(57) ABSTRACT

A portable lumbar support and ergonomic chair having a lumbar support. The lumbar support has a seat hingedly coupled to a seat back having a teardrop-shaped lumbar support seat back cushion. A rigid back support portion may be rotated forward about hinges to collapse substantially parallel to the seat frame and backward to open to a variety of angles with respect to the seat frame. The seat back freely pivots around an upper lateral axis, and the rigid back support portion is linearly adjustable to space the seat back toward and away from the hinges to enable raising or lowering the upper lateral axis and thus the seat back with respect to the lower lateral axis. This provides multiple ways of changing which part of the teardrop-shaped lumbar support curve hits your lumbar curve for proper support. Variable lumbar lordotic support is thus provided.

20 Claims, 18 Drawing Sheets

(51) Int. Cl.
*A47C 11/00* (2006.01)
*A47C 7/40* (2006.01)

(56) References Cited

U.S. PATENT DOCUMENTS

| | | | | |
|---|---|---|---|---|
| 4,597,386 | A | 7/1986 | Goldstein | |
| 4,730,871 | A | 3/1988 | Sheldon | |
| 4,781,413 | A | 11/1988 | Shumack | |
| 5,297,848 | A | 3/1994 | Grinnel | |
| 5,314,235 | A | 3/1994 | Johnson | |
| 5,433,505 | A | 7/1995 | Coyne | |
| 5,553,917 | A | 9/1996 | Adat | |
| 6,261,213 | B1 | 7/2001 | Frey | |
| 6,334,650 | B1 | 1/2002 | Chien-Chuan | |
| 6,929,325 | B1 | 8/2005 | Geolo | |
| 7,059,678 | B1 | 6/2006 | Taylor | |
| 7,125,079 | B1 | 10/2006 | Lee | |
| 7,445,287 | B2 | 11/2008 | Chou | |
| 7,458,637 | B2 | 12/2008 | Norman | |
| 8,696,064 | B2 | 4/2014 | Pan | |
| D713,192 | S | 9/2014 | Wood | |
| 8,960,799 | B2 | 2/2015 | Yoon | |
| 8,998,321 | B2 | 4/2015 | Piretti | |
| 11,129,479 | B2 * | 9/2021 | Snyder | A47C 7/14 |
| 2003/0055365 | A1 | 3/2003 | Hazard | |
| 2003/0107250 | A1 | 6/2003 | Staarink | |
| 2007/0001497 | A1 | 1/2007 | Diffrient | |
| 2007/0096523 | A1 | 5/2007 | Greene | |
| 2007/0120405 | A1 | 5/2007 | Chou | |
| 2012/0299350 | A1 | 11/2012 | Willingham | |
| 2014/0062153 | A1 | 3/2014 | Grove | |
| 2016/0255960 | A1 | 9/2016 | Piretti | |

* cited by examiner

ADJUSTABLE LUMBAR SUPPORT AND ERGONOMIC CHAIR

RELATED APPLICATION

The present application is a continuation of U.S. patent application Ser. No. 16/892,739, filed Jun. 4, 2020, now U.S. Pat. No. 11,129,479 B2, which claims priority under 35 U.S.C. § 119 to U.S. Provisional Application Ser. No. 62/858,825, filed Jun. 7, 2019.

FIELD OF THE INVENTION

The present invention is directed to an orthopedic device for mechanically improving poor posture while sitting and, in particular, to an adjustable lumbar support built into a stand-alone chair or as portable unit that also therapeutically creates spinal joint mobilization, spinal stretching and spinal curve remodeling.

BACKGROUND OF THE INVENTION

Back pain is one of the most common reasons for missed work. One-half of all working Americans admit to having back pain symptoms each year. Experts estimate that up to 80% of the population will experience back pain at some time in their lives.

When you look at the human spine from behind, the spine should be straight and when you look at the spine from the side it should have 3 natural curves shaped like an "S". The neck (cervical spine) and low back (lumbar spine) should both have an inward (concave) curvature known as lordosis or lordotic curve. In the mid-back (thoracic spine) there is an outward (convex) curvature known as kyphosis. These curves normally balance each other out so that when the person stands, they are well balanced with their head straight above their hips when viewed from the side. Standing in this neutral postural position minimizes the effect of gravity and allows the person to stand with their best posture and use the least amount of energy. Well balanced spinal curves will cause the least amount of wear and tear on the spinal joints and discs and minimize pain.

The average person sits for 13 hours a day. One of the most common causes of low back pain is poor sitting posture. Sitting in a slouched position with abnormal posture due to a lack of lumbar support over time can cause a loss of the normal lumbar lordotic curve which can lead to muscle tension, inflammation, restricted motion in the spinal joints, disc degeneration, nerve pressure and back pain. Improper sitting posture can also cause poor posture and pain in other areas such as the mid-back and neck regions.

Current portable lumbar supports as well as ergonomic chairs on the market today lack proper lower back support, they are not customizable, and often the lumbar and thoracic regions are often combined which makes them less supportive and individualized. Current lumbar supports do not accommodate users with a hyperlordosis (exaggerated lumbar curve/swayback), and do not accommodate for different elliptical curves in the user's lumbar spine. With present chairs and lumbar supports, the lumbar support often does not remain in contact when the user leans forward, thus allowing for a loss of the lumbar lordotic curve. They also do not provide spinal mobilization, and do not correct improper lumbar spine curves.

Attempts have been made to create lumbar supports for people when sitting. For instance, U.S. Pat. Nos. 4,730,871, 5,553,917, 7,059,678, and U.S. Patent Publication No. 2007/0096523 disclose adjustable lumbar supports. In addition, there are countless products on the market that claim to provide therapeutic back support. However, none of these provides sufficient adjustments for the variety of body shapes for which help is needed.

Despite numerous lumbar supports on the market, there remains a need for a lumbar support which may be easily adjusted to a wide variety of body shapes.

SUMMARY OF THE INVENTION

The present application provides an adjustable lumbar support which solves many problems caused while sitting by providing customizable lumbar support that accommodates different elliptical curves in the user's lumbar spine. The lumbar support forms a hypolordotic (straight) curve to a hyperlordotic (swayback) curve; does not have a thoracic (upper back) region so it is more supportive and individualized; helps to maintain the lumbar lordotic curve when leaning forward; and provides lumbar spinal joint mobilization and lumbar spine curve correction/remodeling. The lumbar support has a foam seat cushion (foundation member) that the user sits on which is angled and tilts the user backwards to stop forward leaning/slouching.

The lumbar support provides a number of degrees of adjustment freedom, specifically four, in combination with ergonomically shaped seat and back cushions. The seat back frame may be raised in two ways, the seat back freely pivots relative to seat back frame, and the seat back frame may be pivoted relative to the seat.

A further understanding of the nature and advantages of the invention will become apparent by reference to the remaining portions of the specification and drawings.

BRIEF DESCRIPTION OF THE DRAWINGS

Features and advantages of the present invention will become appreciated and become better understood with reference to the specification, claims, and appended drawings wherein:

DETAILED DESCRIPTION OF THE PREFERRED EMBODIMENTS

The lumbar support of the present application generally comprises a cushioned seat and a contoured and cushioned seat back pivotally attached to the seat via a frame system so as to assume several different modes of operation. The lumbar support may be formed as a portable item which can be utilized independently or placed on an existing chair. Alternatively, the lumbar support can be formed as a stand-alone chair by incorporating a lower support stand such as legs or a wheeled assembly. By "incorporating" is meant that the lumbar support is a built-in feature of the chair and cannot be removed from the support stand.

Two primary embodiments are disclosed herein, in FIGS. 1-15 and in FIGS. 16-24C. It should be understood that various differences are described, and that any one compatible feature in one embodiment can be substituted into the other, and vice versa. For instance, the lower supports (legs, wheeled assembly) in the version of FIGS. 1-15 may be incorporated into the version of FIGS. 16-24C.

Figure 1B:
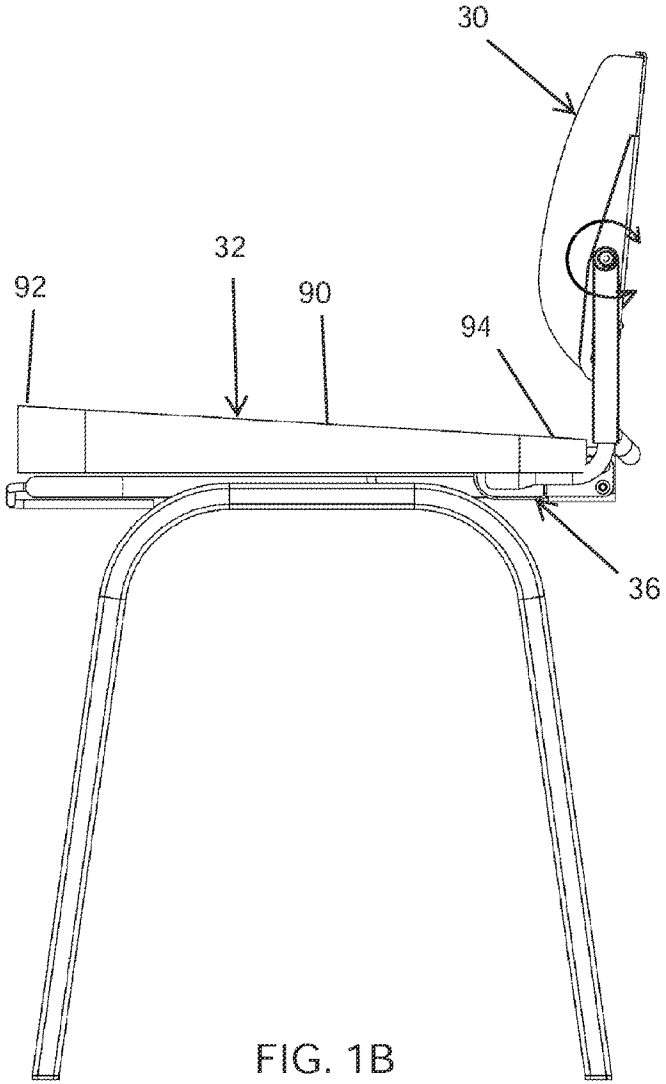
FIG. 1B is a side elevational view thereof.
Figure 1A:
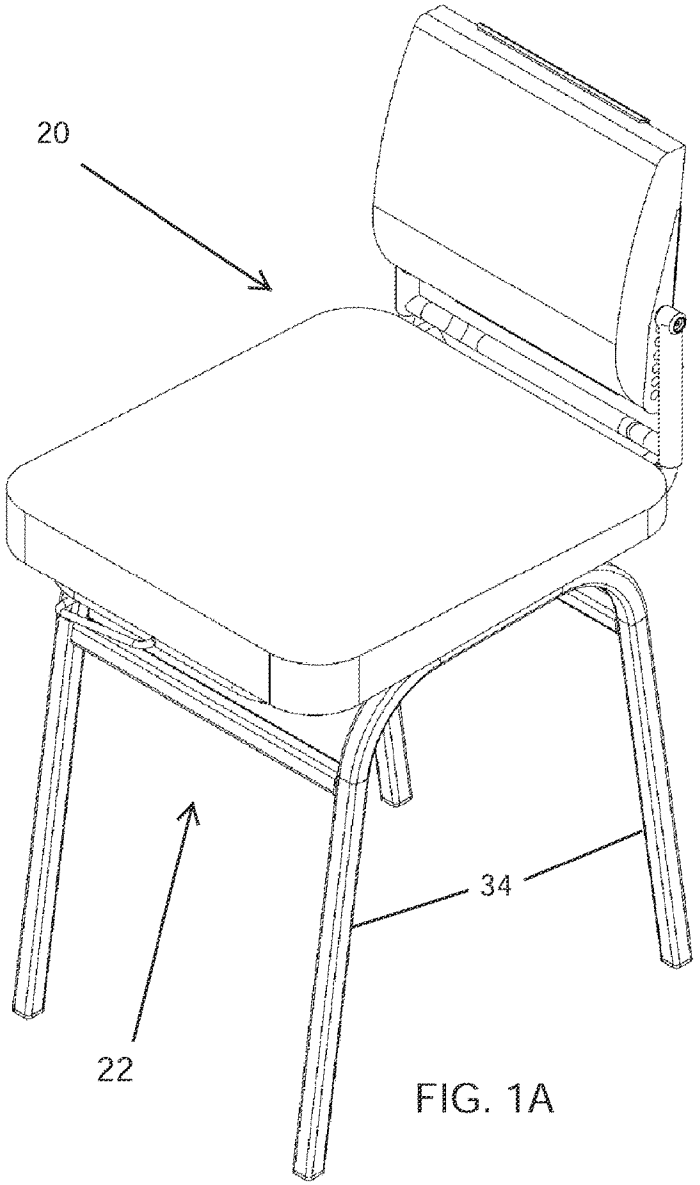
FIG. 1A is a perspective view of an exemplary lumbar support incorporated into a four-legged chair.

FIG. 1A is a perspective view of an exemplary lumbar support 20 incorporated into a stationary four-legged chair 22, and FIG. 1B is a side elevational view thereof. As mentioned, a cushioned seat back 30 is positionally and rotatably connected to a cushioned seat 32. Legs 34 of the chair forming a lower support stand are rigidly connected to a frame system 36, which can be adjusted to change the contours and angle of the seat back 30 relative to the seat 32.

For continuity, the various elements of the lumbar support 20 will be given the same numbers for both portable and incorporated versions.

Figure 2:
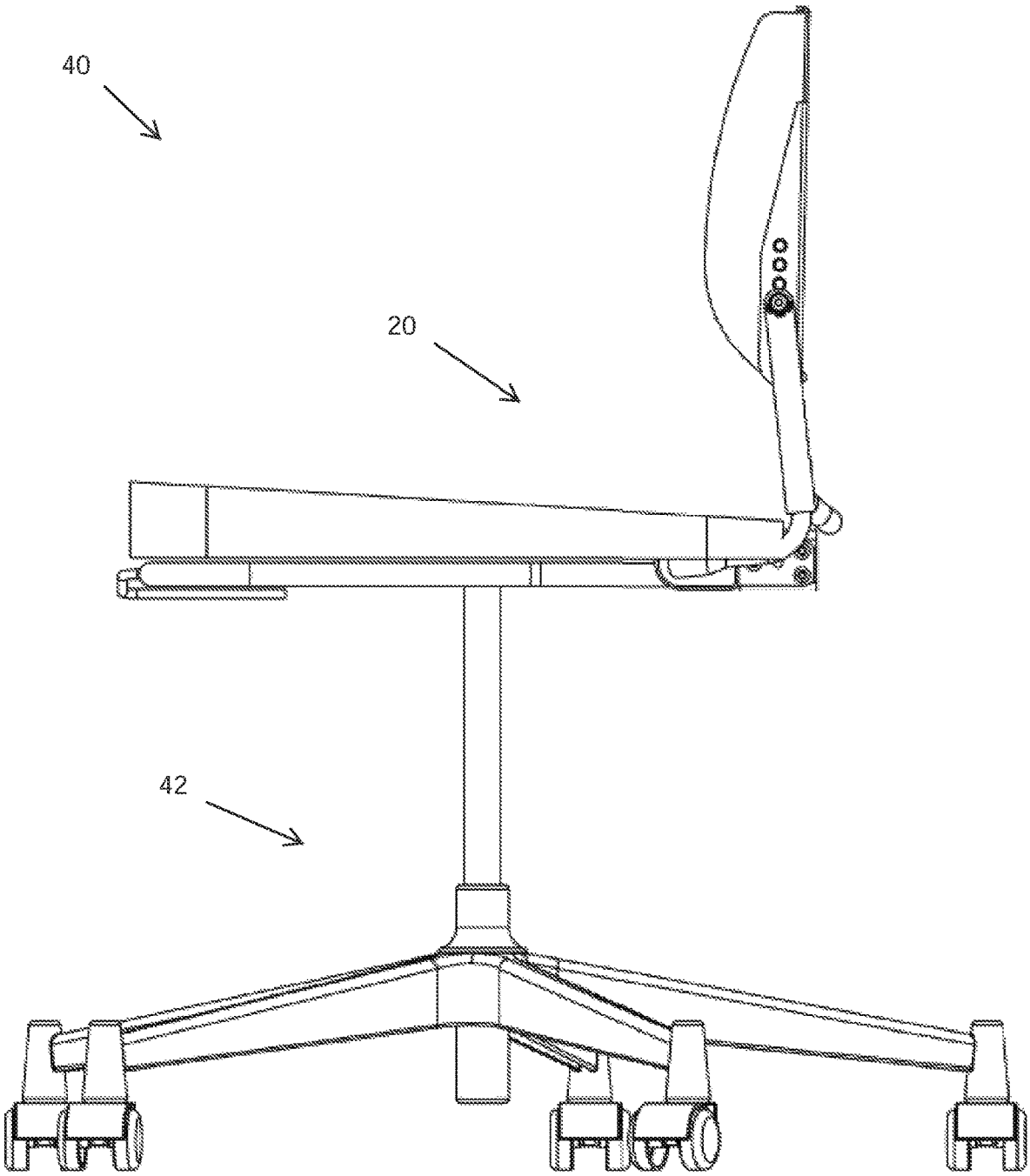
FIG. 2 is a side elevational view of an exemplary lumbar support incorporated into a rolling desk chair.
Figure 3:
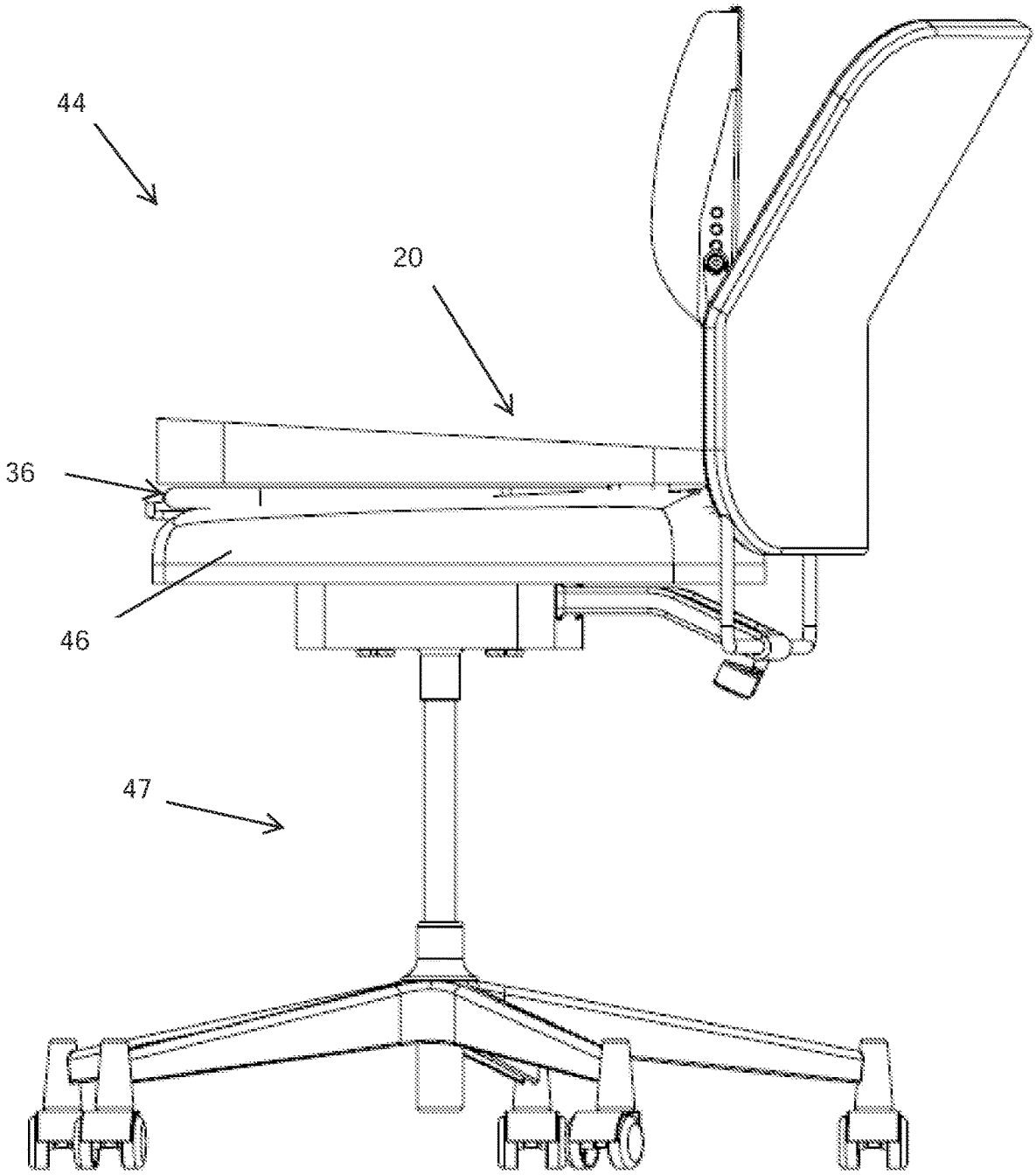
FIG. 3 is a side elevational view of a rolling desk chair having an exemplary portable lumbar support positioned thereon.

FIG. 2 is a side elevational view of an exemplary lumbar support 20 as part of a rolling desk chair 40 incorporating a lower support stand in the form of a wheeled assembly 42, and FIG. 3 is a side elevational view of a rolling desk chair 44 having an exemplary portable lumbar support 20 positioned thereon. In this embodiment, the frame system 36 of lumbar support 20 rests directly on a seat 46 of the desk chair 44, which is supported by a wheeled assembly 47. It should be noted that the lumbar support 20 may be secured to an existing chair such as the desk chair 44, or a bleacher or bench which do not already have a seat back for safety in a variety of ways, including by rotating down a stadium seat hook as will be described below.

Figure 4B:
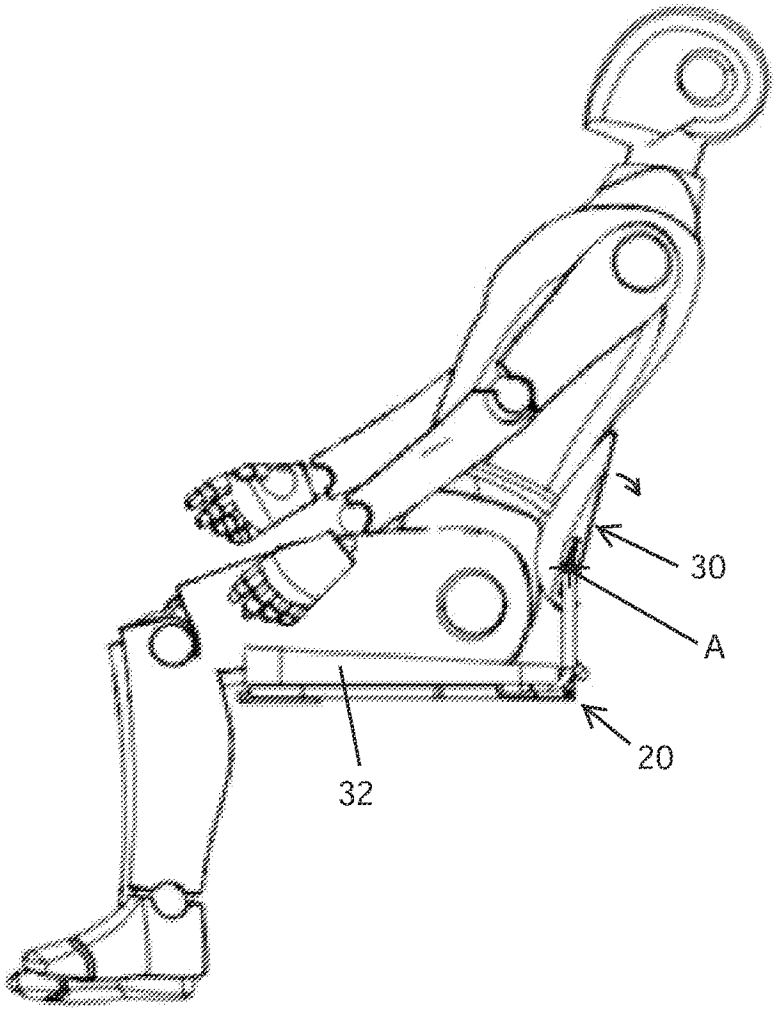
FIGS. 4A and 4B are side elevational views of the portable lumbar support shown with a body thereon in two different adjustment modes, where the user is leaning backwards in 4B for spinal mobilization and spinal stretching.
Figure 4A:
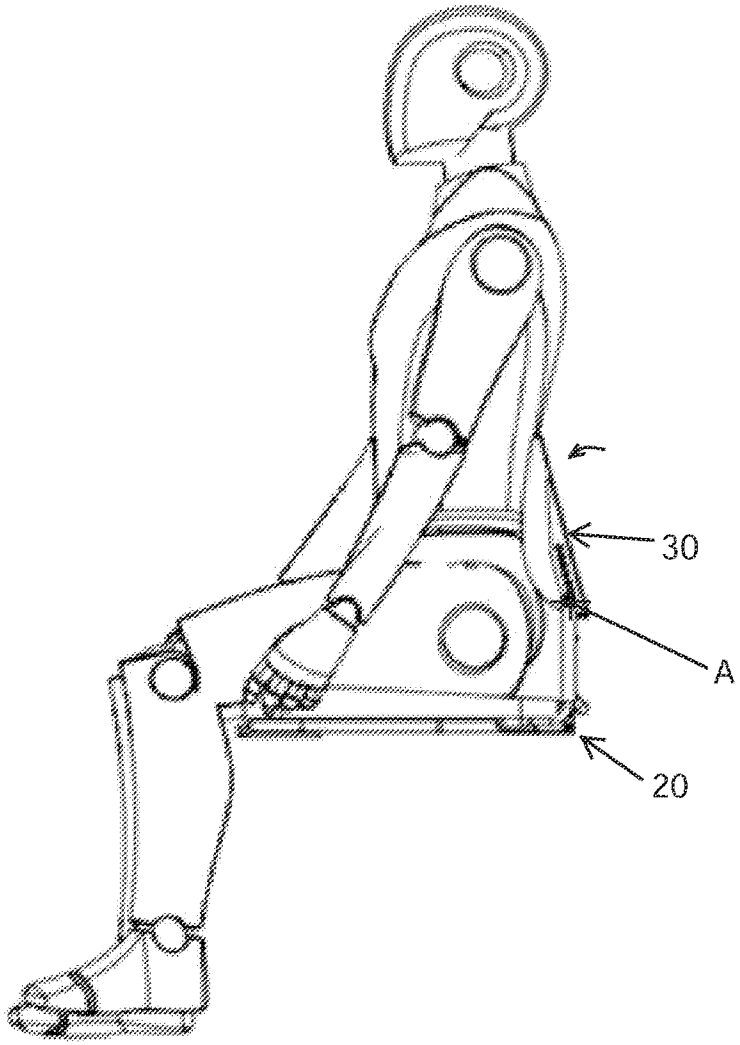

FIGS. 4A and 4B are side elevational views of the portable lumbar support 20 shown with an example of a human body thereon in two different adjustment modes. In FIG. 4A, the seat back 30 is relatively upright, while in FIG. 4B, the seat back 30 has been pivoted backwards by the user leaning back in order to provide spinal mobilization and spinal stretching. The seat back 30 is freely pivotable about an upper lateral axis A and naturally adjusts to the lordotic (spinal) curvature of the user in any seated position. As will be explained below, the height of the seat back 30 is adjustable as well as its angled position relative to the seat 32, such that various users and a variety of positions may be accommodated. Furthermore, the seat back 30 has a tear-drop-shaped cushion as will be explained which conforms to the lordotic lumbar curvature at various heights due to the freely pivoting nature of the seat back. One way to see the adaptability of the lumbar support 20 is to imagine the seat back 30 rotated forward relative to the seat 32. Because of the freely pivoting nature of the seat back 30, it will not squish or otherwise provide discomfort to the user, but instead will rotate and conform to the user's back.

Figure 5B:
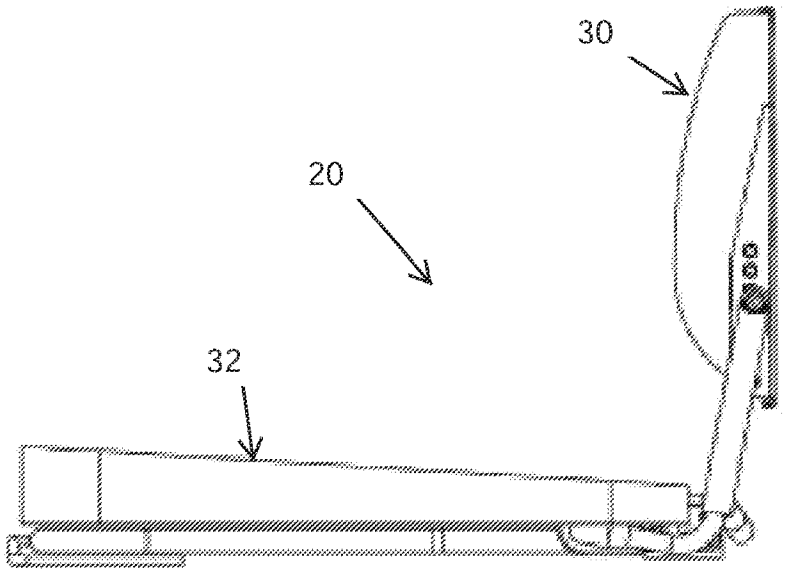
FIGS. 5A-5C are orthogonal views of the portable lumbar support shown both expanded and folded down into a smaller profile.
Figure 5A:
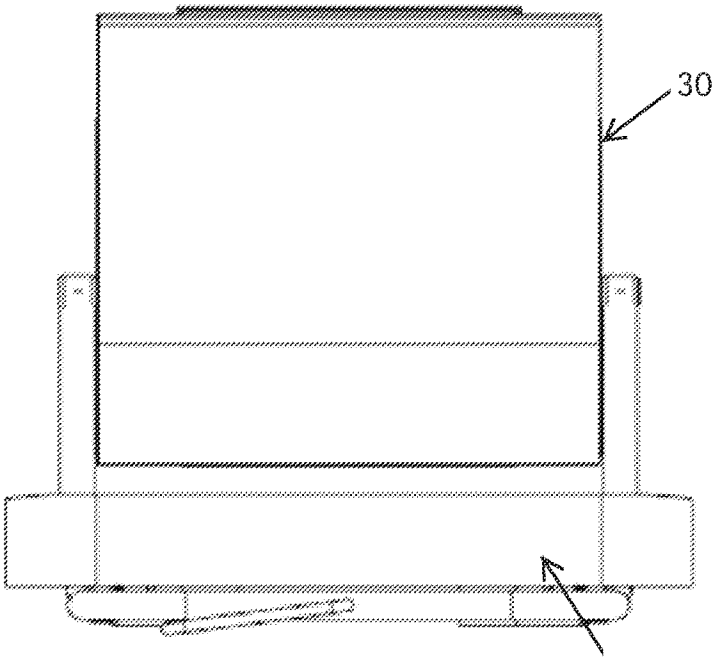
Figure 5C:
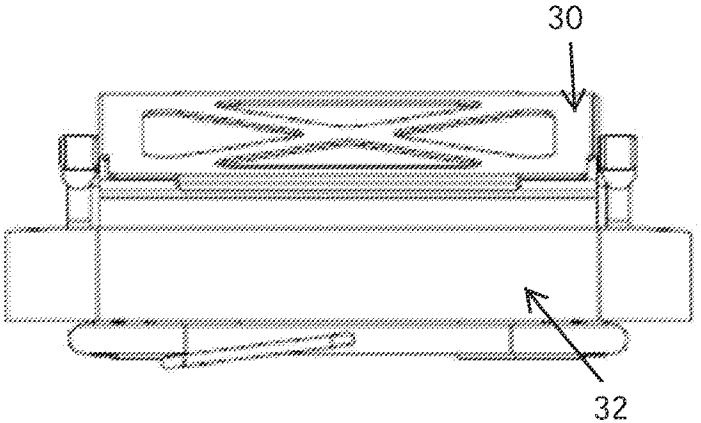

FIGS. 5A-5C are orthogonal views of the portable lumbar support 20 shown both expanded and folded down or collapsed into a smaller profile. That is, in FIG. 5C, the seat back 30 has been rotated downward so as to lie flush against the seat 32. This reduces the size of the lumbar support 20 for easier portability.

Figure 6A:
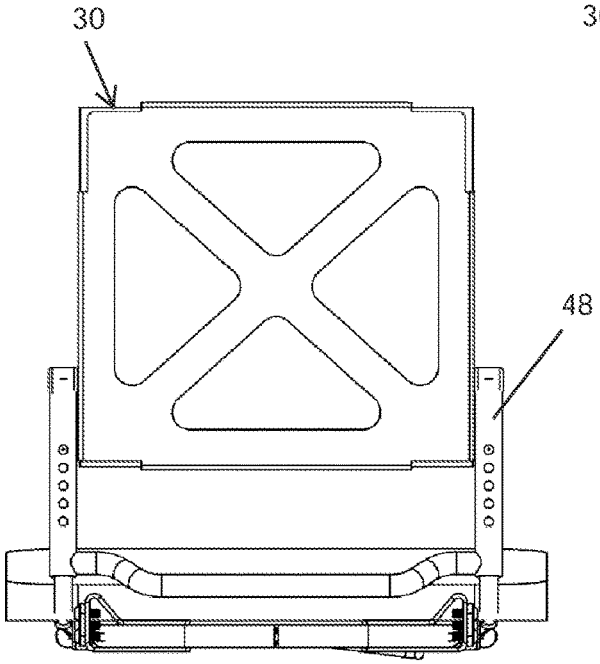
FIGS. 6A/6B are back and side elevational views of the portable lumbar support in a first mode of operation, and FIGS. 7A/7B are back and side elevational views of the portable lumbar support in a second mode of operation wherein a seat back has been raised relative to an intermediate frame member.
Figure 7A:
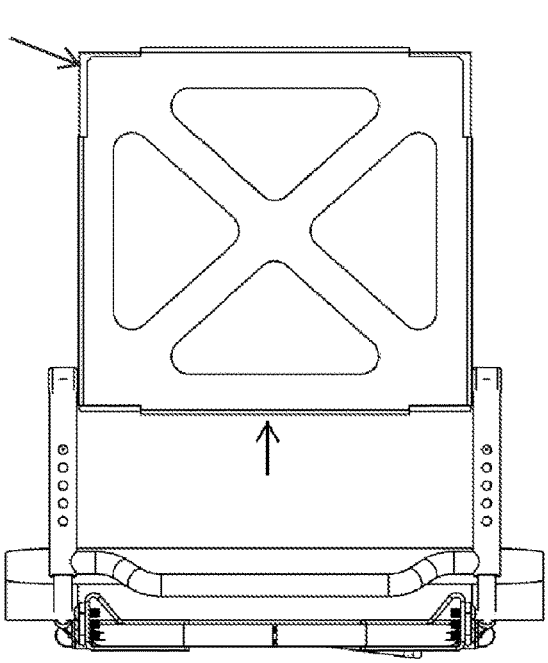
Figure 6B:
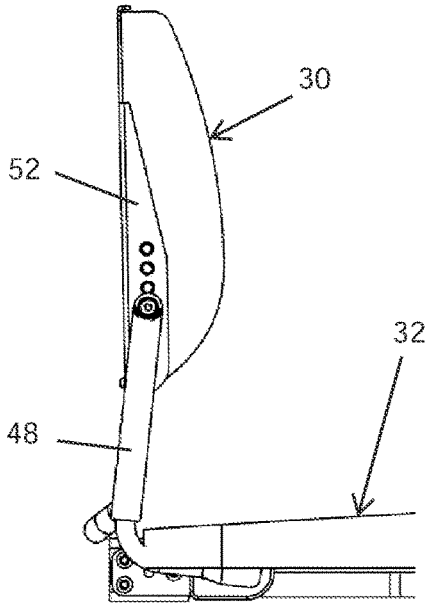
Figure 7B:
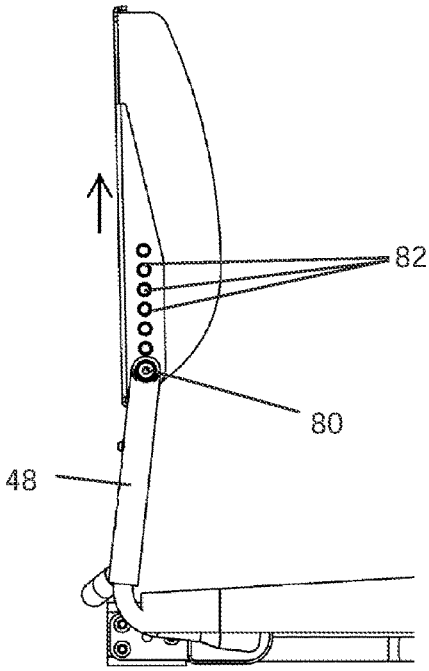
Figure 8B:
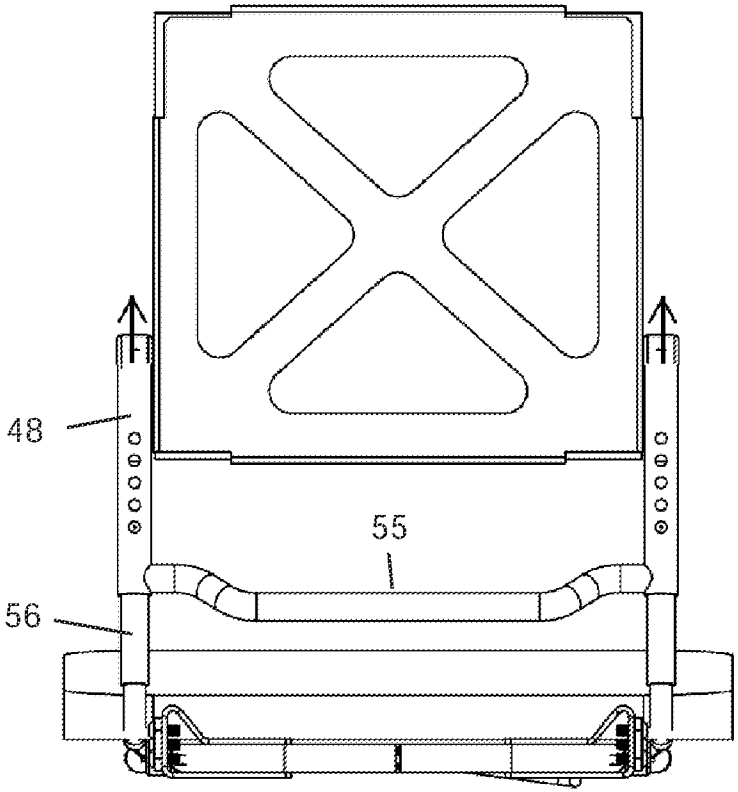
FIG. 8B is a back elevational view of the portable lumbar support in a fourth mode of operation wherein the intermediate frame member has been raised relative to a lower rotating member.
Figure 8A:
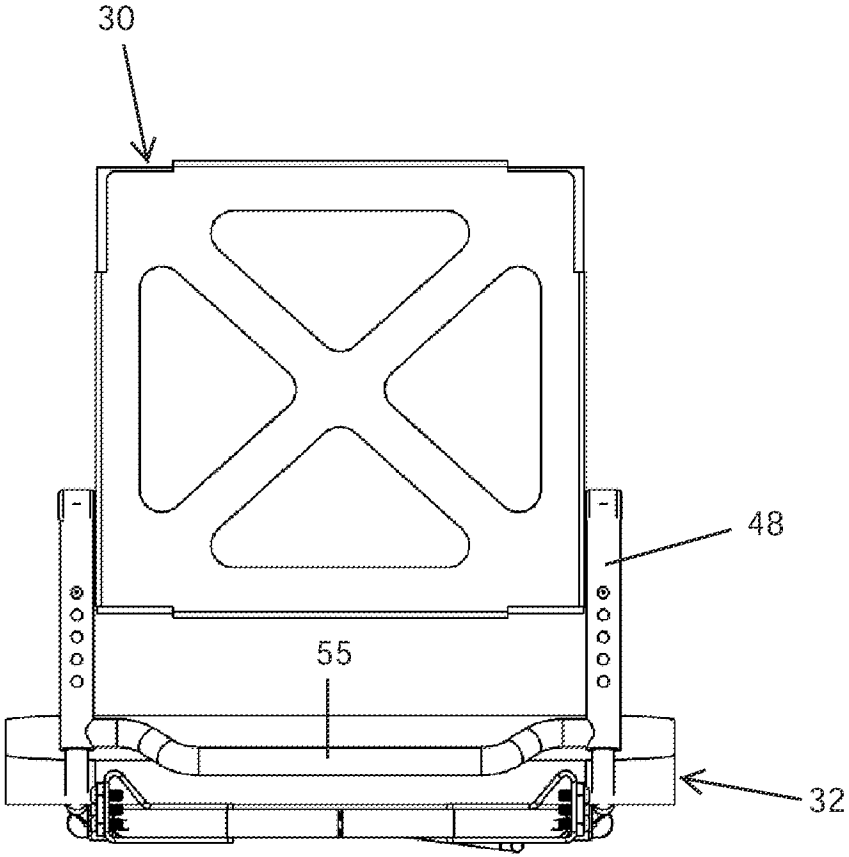
FIG. 8A is a back elevational view of the portable lumbar support in a third mode of operation.

FIGS. 6A/6B are back and side elevational views of the portable lumbar support in a first mode of operation, and FIGS. 7A/7B are back and side elevational views of the portable lumbar support in a second mode of operation wherein the seat back 30 has been raised relative to an intermediate frame member 48. FIG. 8A is a back elevational view of the portable lumbar support in a third mode of operation, and FIG. 8B is a back elevational view of the portable lumbar support in a fourth mode of operation wherein the intermediate frame member 48 has been raised relative to a lower rotating member 56. In FIG. 8A, the intermediate frame member 48 and seat back 30 are in approximately the same positions as seen in FIG. 6A. In FIG. 8B, the intermediate frame member 48 has been raised relative to the lower rotating members 56. Prior to further explanation of the various positions available for the user, elements of the frame system 36 will be described with respect to FIGS. 9-11.

Figure 9B:
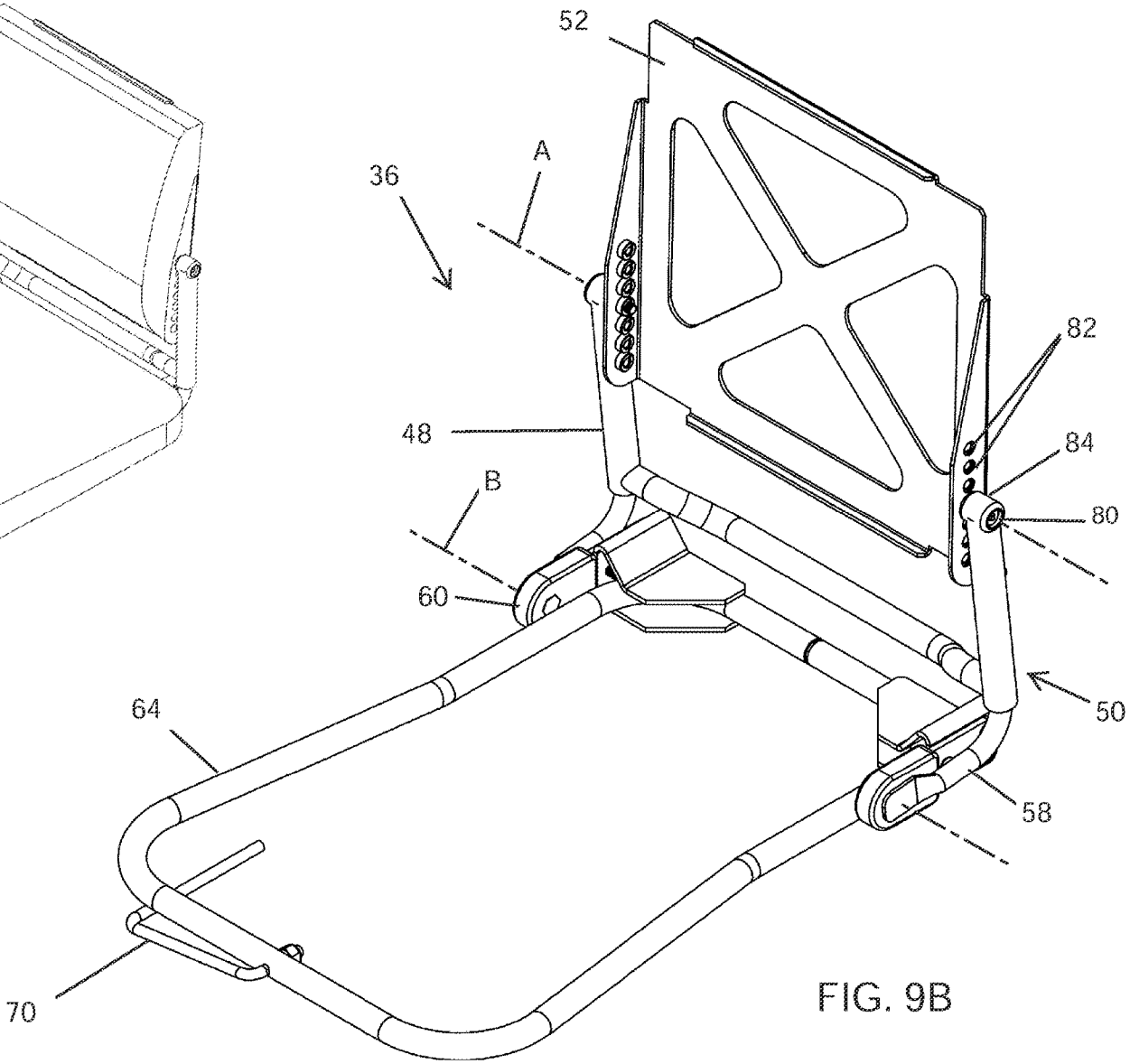
FIG. 9B is a perspective view of just a frame system of the portable lumbar support, with cushions removed.
Figure 9A:
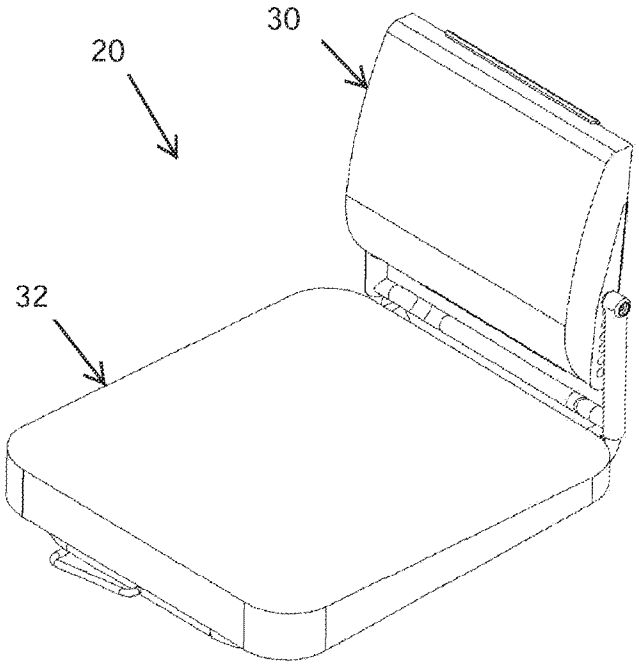
FIG. 9A is an assembled perspective view of the portable lumbar support.
Figure 10:
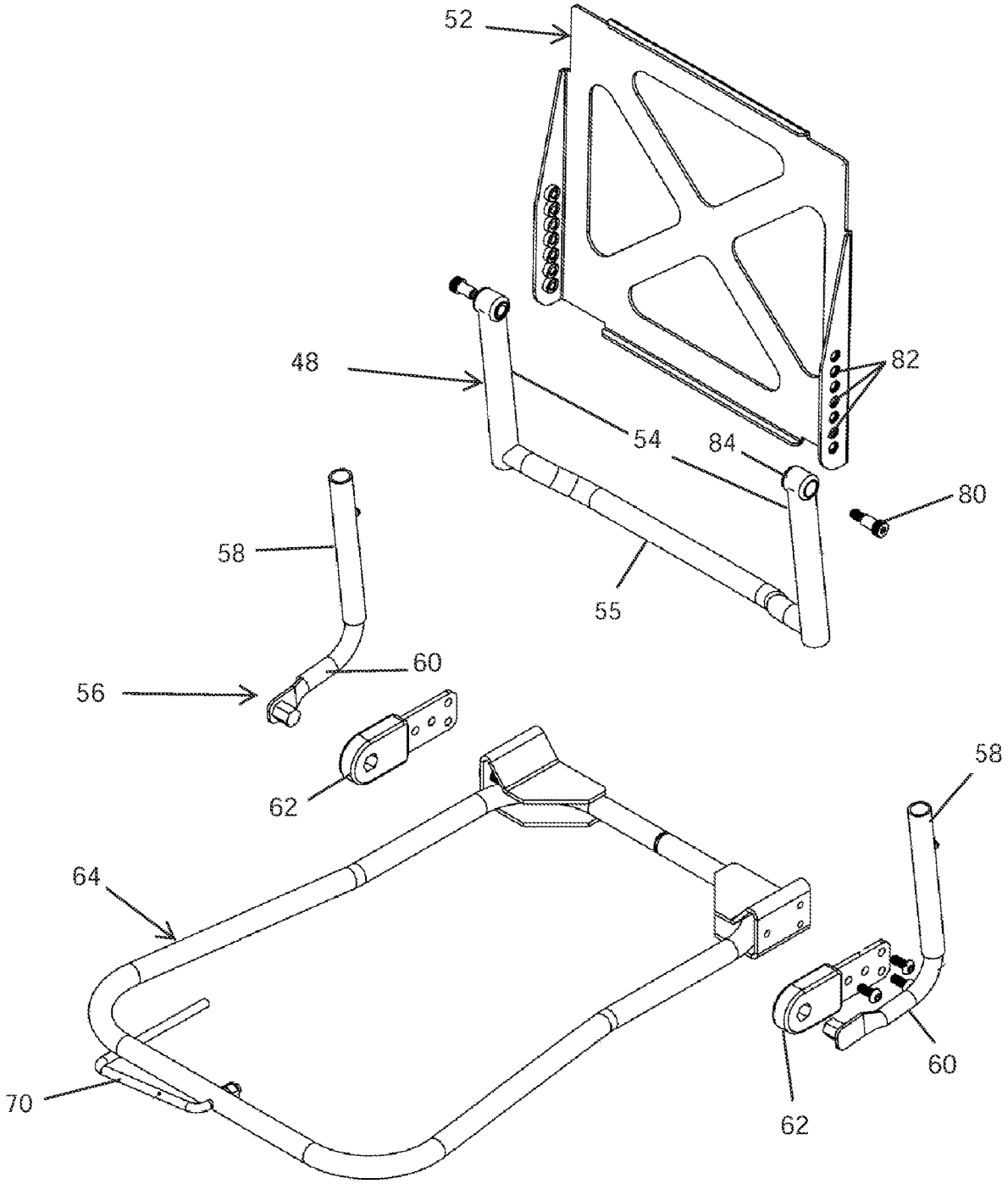
FIG. 10 is an exploded perspective view of the frame system of the portable lumbar support.
Figure 11:
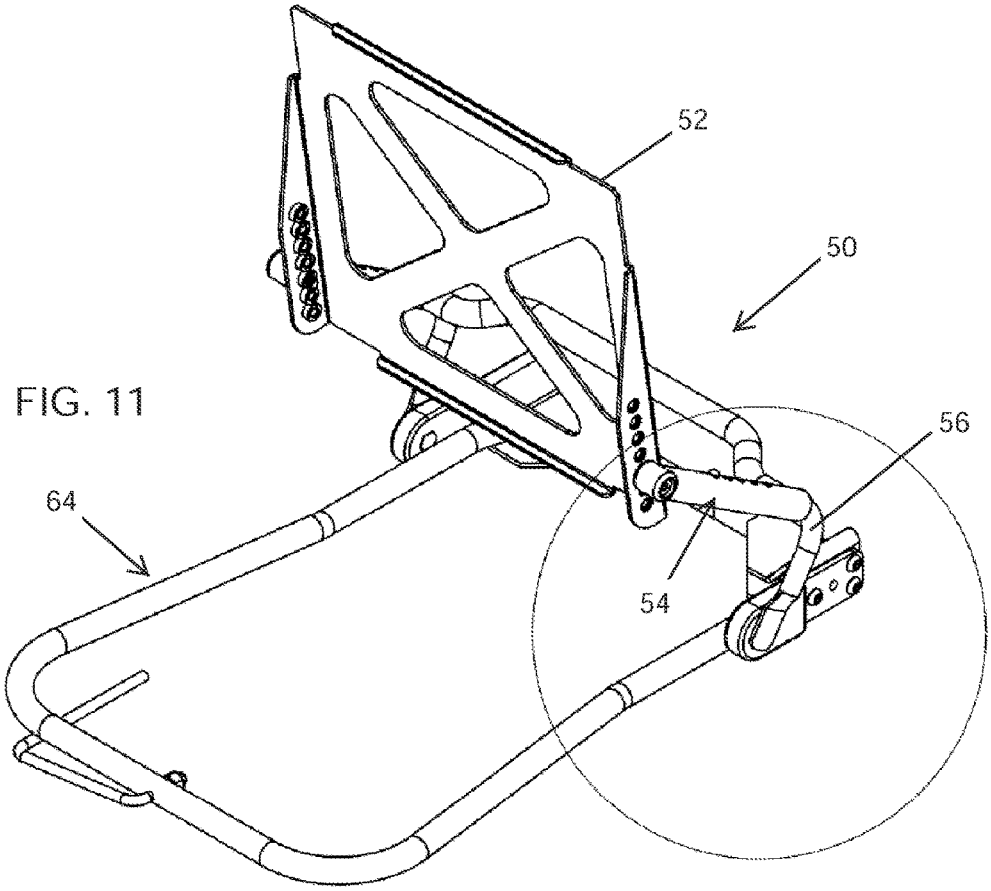
FIG. 11 is an assembled perspective view of the frame system with a back support portion rotated forward.
Figure 11A:
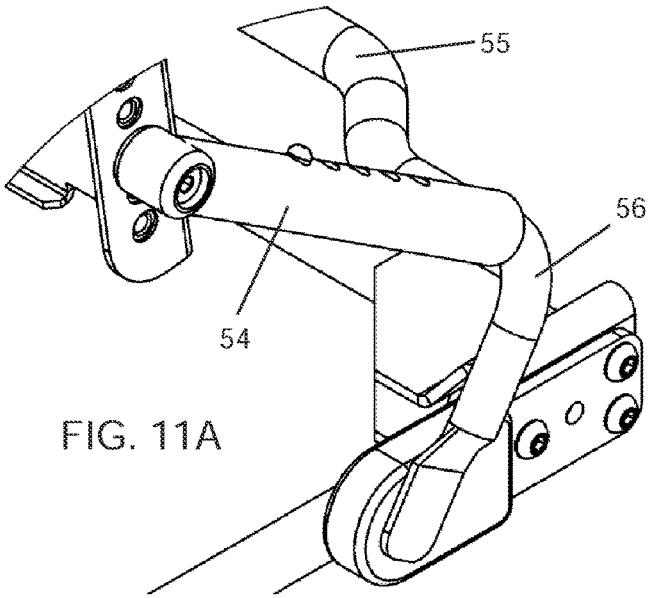
FIG. 11A is an enlargement of a portion of the frame system of FIG. 11.
Figure 11B:
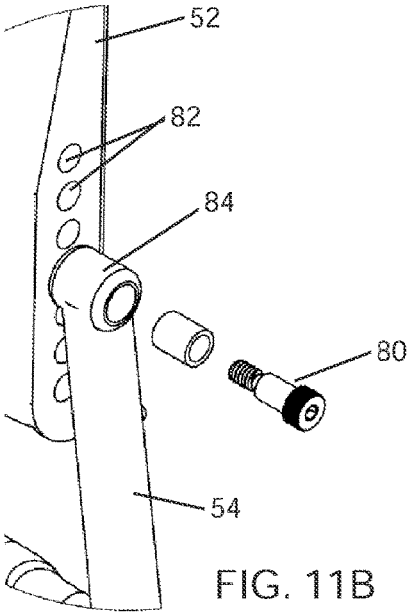
FIG. 11B is an enlargement exploded view showing a connection between the seat back and the intermediate frame member.

FIG. 9A is an assembled perspective view of the portable lumbar support 20, and FIG. 9B is a perspective view of just a frame system 36 of the portable lumbar support, with cushions removed. FIG. 10 is an exploded perspective view of the frame system 36 of the portable lumbar support. FIG. 11 is an assembled perspective view of the frame system 36 with a back support portion 50 rotated forward, and FIGS. 11A and 11B are enlargements thereof.

The frame system 36 includes the intermediate frame member 48 which is somewhat U-shaped and pivotally connected to a seat back panel 52 about upper lateral pivot axis A. The intermediate frame member 48 has two laterally spaced tubular struts 54, connected by a horizontal stabilization bar 55, that receive telescopically therein tubular extension struts 58 of the lower rotating members 56. There are two lower rotating members 56 that each has a rotatable strut 60 arranged to rotate relative to a hinge member 62 about lower lateral pivot axis B. The two hinge members 62, in turn, fasten to outside rear corners of a seat frame 64 to which the cushioned seat 32 is secured. The assembly of the seat back panel 52, intermediate frame member 48, and lower rotating members 56 and their engaging hardware are collectively termed the back support portion 50, which may be rotated together relative to the seat frame 64 about lower lateral axis B.

FIGS. 9B and 10 also illustrate the aforementioned stadium seat hook 70 which is rotatably connected at a front end of the seat frame 64. For lumbar supports 20 that are portable, the stadium seat hook 70 may be rotated downward and latched underneath a stadium seat, bleacher or bench so as to prevent the user from tilting back on the lumbar support.

Now with reference back to FIGS. 6A/6B and 7A/7B, the seat back 30 is shown relatively upright or perpendicular to the seat 32. The seat back 30 may be raised relative to the intermediate frame member 48 by disengaging and then re-engaging buttons 80 (which may be screwed-in or spring-loaded) with a plurality of receiving holes 82 provided in both sides of the seat back panel 52. As seen in FIGS. 9B, 10 and 11B, the buttons 80 pass through coupling bores 84 at the terminal ends of the tubular struts 54. Although the buttons 80 may be spring-loaded for quick adjustment, they may also be threadingly engaged with the receiving holes 82 and loosened and tightened with an Allen wrench, for example. In another example, a quick-release type of adjustment mechanism, the buttons 80 may instead be spring-loaded pins which extend inward into one of the receiving holes 82 on each side such that a user need only pull both pins outward to move the seat back 30 up or down. Adjusting the seat back 30 up or down changes the pivot point of the freely pivoting Lordotic curve of the seat back cushion 100 for proper support, mobilization and curve remodeling, as will be made more apparent below.

Figure 12C:
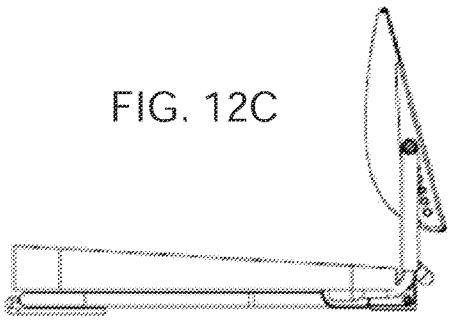
FIGS. 12A-12C are side elevational views of the portable lumbar support in a first configuration with a back support portion upright and the seat back shown at different pivot angles.
Figure 12B:
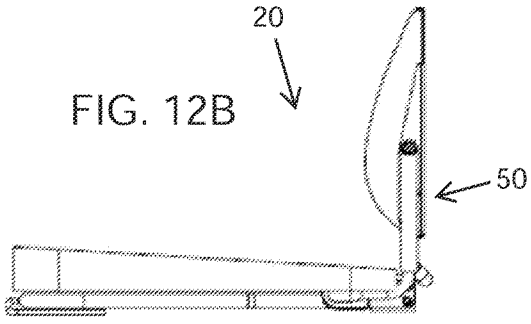
Figure 12A:
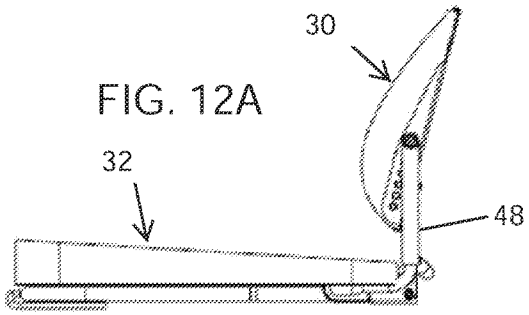
Figure 13C:
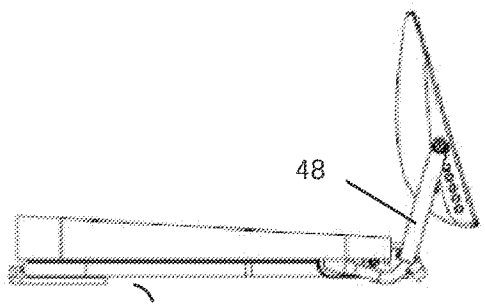
FIGS. 13A-13C are side elevational views of the portable lumbar support with the back support portion in different rotational positions and the seat back shown at different pivot angles.
Figure 13B:
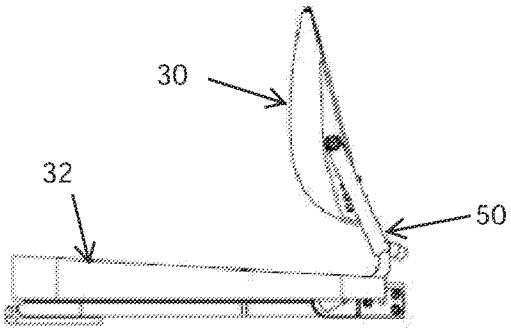
Figure 13A:
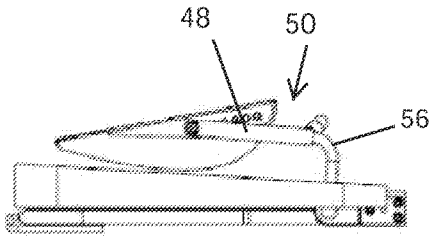
Figure 14C:
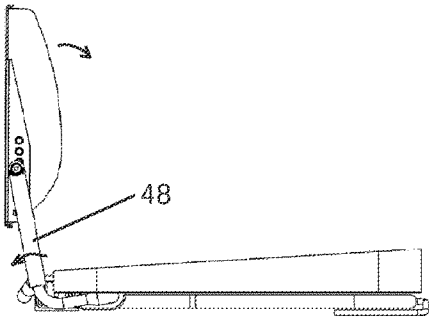
FIGS. 14A-14C are side elevational views of the portable lumbar support with the back support portion in different rotational positions and the seat back shown at different pivot angles.
Figure 14B:
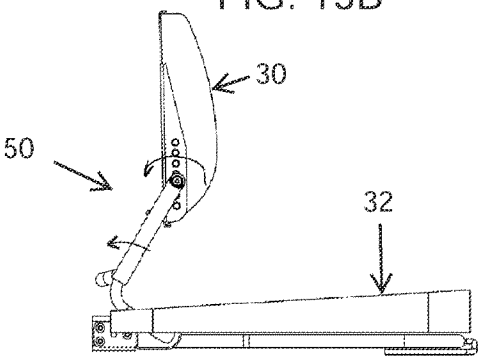
Figure 14A:
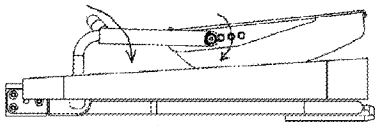

FIGS. 12A-12C, 13A-13C and 14A-14C are side elevational views of the portable lumbar support 20 in a variety of configurations with the back support portion 50 and/or seat back 30 shown at different positions/angles. FIGS. 12A-12C show the intermediate frame member 48 rotated upright, and the seat back 30 at a low position and at different pivot angles relative to the intermediate frame member 48. FIGS. 13A-13C show the back support portion 50 including the intermediate frame member 48 and lower rotating members 56 at different angles relative to the seat 32, and also the seat back 30 at a low position and at different pivot angles relative to the intermediate frame member 48. Finally, FIGS. 14A-14C show the back support portion 50 at different angles relative to the seat 32, and also the seat back 30 at an intermediate position and at different pivot angles relative to the intermediate frame member 48. Aside from the collapsed positions of FIGS. 13A and 14A, each of these positions of the portable lumbar support 20 may be formed by the user with the freely rotating seat back 30 providing proper lumbar support in each.

Figure 15B:
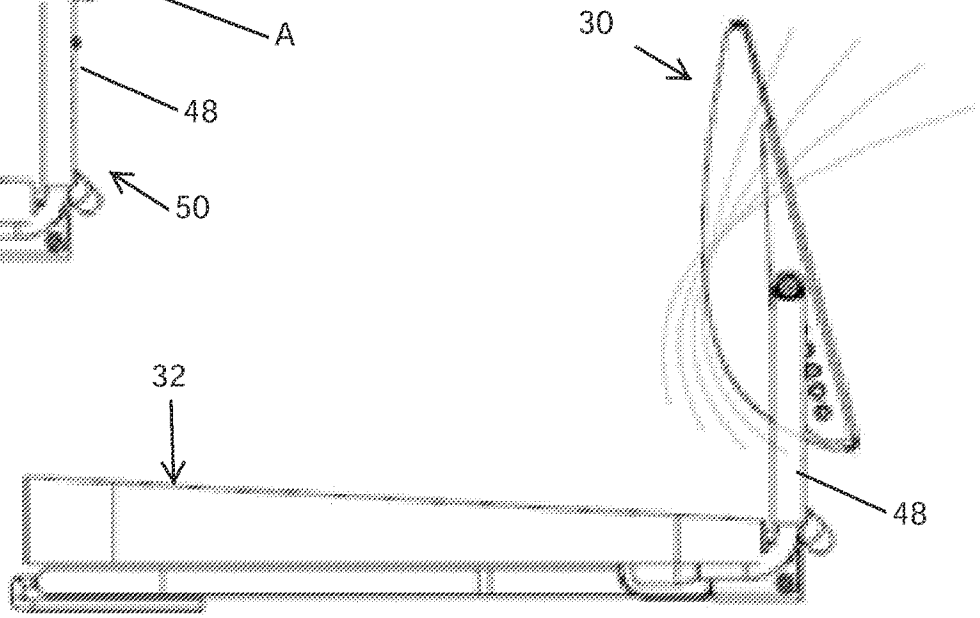
FIGS. 15A and 15B are side elevational views of the portable lumbar support in two different elevations of the seat back relative to the intermediate frame member, and showing potential shapes formed by the freely pivotable seat back at different angles.
Figure 15A:
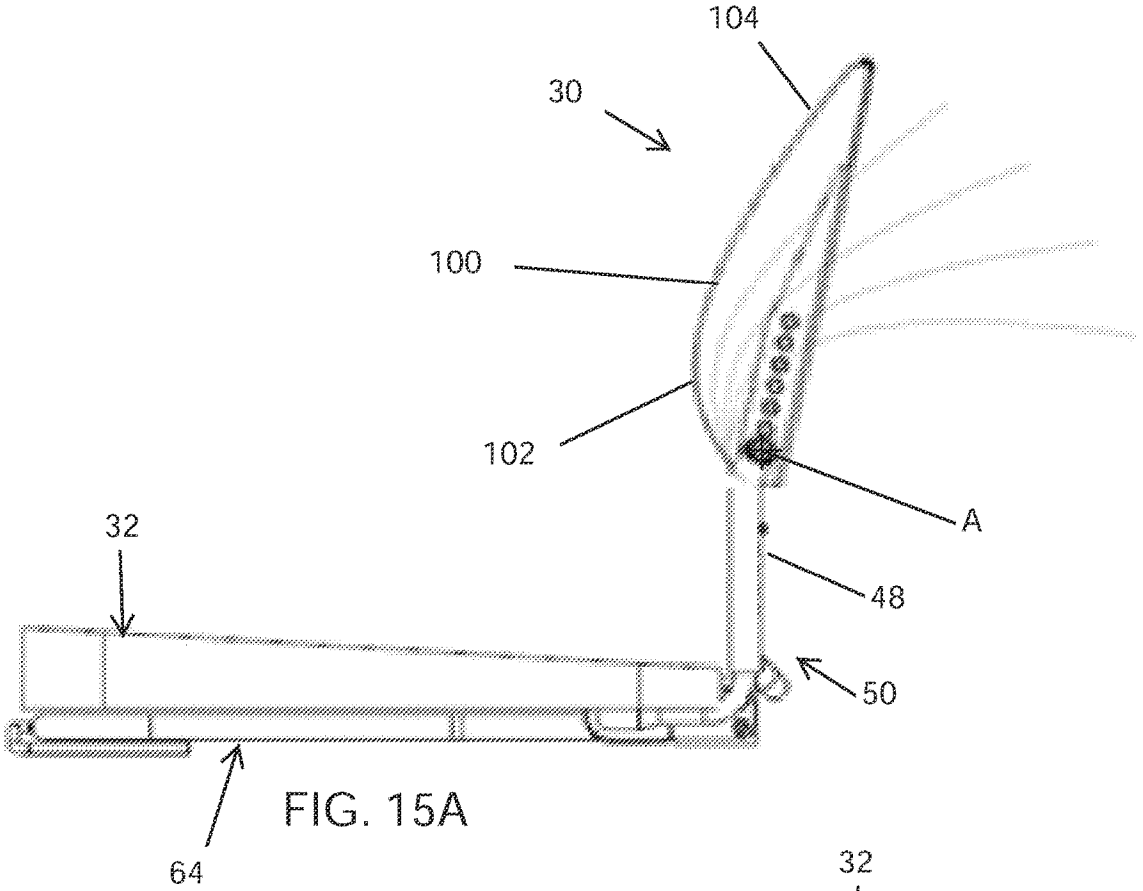

FIGS. 15A and 15B are side elevational views of the portable lumbar support 20 in two different elevations of the seat back 30 relative to the intermediate frame member 48, showing potential curvilinear shapes formed by the seat back at different pivot angles. As mentioned, the seat back 30 is free to rotate about its upper lateral pivot axis A and thus adjusts to these curvilinear shapes automatically depending on the seated position of the user. Due to the teardrop shape of the seat back cushion 100, as will be described in more detail below, proper lumbar support is provided by the seat back in any seated position of the user. These curves are just a sample of the many that may be described by repositioning the seat back 30 relative to the intermediate frame member 48, and the reader will understand that a new set of such curves may be described by rotating the entire back support portion 50 relative to the seat frame 64 to which the cushioned seat 32 is secured, as well as by further adjusting the height of the seat back pivot axis relative to the seat.

The lumbar support provides many advantages/features, including:

The portable mechanism can be placed directly on top of a chair; bench, stadium seat, bleacher, wheelchair etc. or the mechanism can be built directly into a chair.

The lumbar support provides a number of degrees of adjustment freedom, specifically four, including ergonomically shaped freely pivotable seat and back cushions. The seat back frame may be raised in two ways, the seat back freely pivots relative to seat back frame, and the seat back frame may be rotated relative to the seat (forward and backward adjustment). This provides multiple ways of changing which part of the seat back's curve hits your lumbar curve properly.

As seen in FIG. 1B, for example, the mechanism has a foam seat cushion (foundation member) 90 as part of the seat 32 that the user sits on. The front 92 of the cushion 90 is near the user's knees while the rear 94 of the cushion is near the user's buttocks. The front of the foam cushion 90 is taller than the rear of the cushion. This angle tilts the user backwards and stops the user from slouching/leaning and sliding forward on the seat. The foam within the cushion 90 may be denser in the front 92 than it is in the rear 94 in order to prevent the user from slouching/leaning and sliding forward in their seat.

The foam may extend over the seat frame 64 in order to conform to the seat it is placed on (portable version).

The foam cushion sits upon the seat frame 64 as seen in FIG. 9B. The seat frame 64 preferably has 4 sides and may be narrower in the rear than the front.

Two ratcheted gears are attached at the rear of both sides of the seat frame 64, enclosed within the hinge members 62 seen in FIGS. 9B and 10. The gears ratchet in a forward direction when rotating toward the front of the device, or toward a collapsed position. This locks the back support portion 50 into place relative to the seat 32 at incremental rotational positions, preventing the seat back from rotating backwards in the opposite direction, which gives the user their desired lower back support. The back support portion 50 may be released to rotate backward only upon full forward rotation to the collapsed position, seen in FIGS. 13A and 14A, as with some chaise lounges, for example.

Each gear is also attached to a lower rotating member 56 having a tubular extension strut 58 that fits inside one of the tubular struts 54 and telescopes vertically via a plurality of adjustment holes with a pin. This allows the user to adjust the height of the tubes to fit the height of the user's lumbar spine.

Between the two vertical tubular struts 54 is the horizontal stabilization bar 55. This bar also functions as a handle to carry the portable device, as can be understood from FIGS. 13A and 14A.

Attached to the top of both vertical tubular struts 54 is the coupling bore 84 that is perpendicular to the tubular struts 54 and allows for attachment to the seat back panel 52 and thus seat back 32. This short horizontal coupling bore 84 is a tube that may have bushings, washers, bearings and a screw in it to allow for swiveling of the seat back panel 52 around a horizontal axis.

As seen in FIG. 15A, for example, the front of the rectangular seat back panel 52 has a foam lumbar support cushion 100 attached to it. The lumbar support foam may be either open or closed cell foam. Denser open cell foam or closed cell foam may be used for spinal mobilization and curve correction of the lumbar spine while slightly less dense open cell foam may be used for lumbar support. The foam lumbar support cushion 100 is convex and elliptical in shape to the match to the user's lumbar lordotic curve (lower back) which is concave. The shape of the front of the support cushion 100 is like a teardrop, with a greater arc/curvature in the bottom region 102 than in the top region 104 which is less curved. This allows the user to match the part of the arc/curvature of the foam lumbar support cushion 100 with their own unique arc/curvature of their lumbar spine. One type of foam that is desirable is Ethylene-Vinyl Acetate (EVA).

As explained above, the seat back panel 52 has a plurality of vertical adjustment holes to which to attach the vertical tubular struts 54. The vertical holes of the seat back panel 52 change where the horizontal axis is in relation to the teardrop curve of the lumbar support. The higher the hole on the seat back panel 52 that the tubular struts 54 are attached, the higher up on the foam lumbar support cushion 100 that will come in contact with the user's lumbar curvature. Users with a hypolordotic (straighter spine) curvature in their lumbar spine will find it more comfortable to use a higher hole setting on the lumbar frame while the opposite is true for someone with a hyperlordotic (swayback) lumbar curvature. This allows for a custom fitting of the lumbar support curve to the user's unique lumbar curve.

Figure 16:
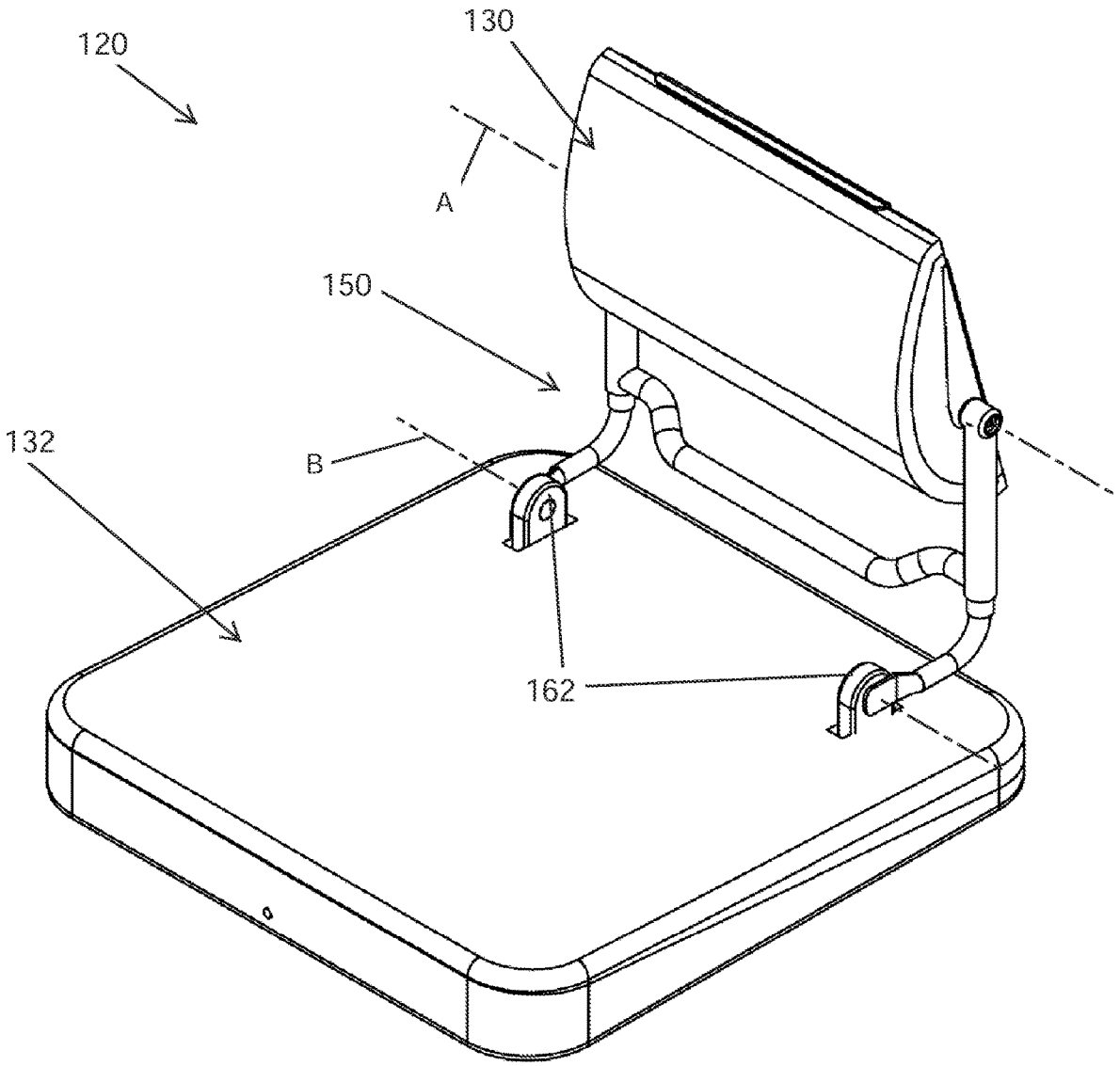
FIG. 16 is an assembled perspective view of an alternative portable lumbar support in accordance with the principles described herein.

FIG. 16 is an assembled perspective view of an alternative portable lumbar support 120 in accordance with the principles described herein. The portable lumbar support 120 has a cushioned seat back 130 positionally and rotatably connected to a cushioned seat 132. The seat back 130 is freely pivotable about an upper lateral axis A via a back support portion 150. The seat back 130 naturally adjusts to the lordotic (spinal) curvature of the user in any seated position.

The lumbar support 120 provides a number of degrees of adjustment freedom, specifically three, including ergonomically shaped freely pivotable cushioned seat back 130. The seat back 130 may be raised, the seat back 130 freely pivots relative to the back support portion 150, and the back support portion 150 may be rotated relative to the seat 132 (forward and backward adjustment). This provides multiple ways of changing which part of the seat back's curve hits your lumbar curve properly.

As with the first embodiment, the height of the seat back 130 is adjustable as well as its angled position relative to the seat 132, such that various users and a variety of positions may be accommodated. Furthermore, the seat back 130 has a teardrop-shaped cushion as will be explained which conforms to the lordotic lumbar curvature at various heights due to the freely pivoting nature of the seat back. One way to see the adaptability of the lumbar support 120 is to imagine the seat back 130 rotated forward relative to the seat 132. Because of the freely pivoting nature of the seat back 130, it will not squish or otherwise provide discomfort to the user, but instead will rotate and conform to the user's back.

Figure 17:
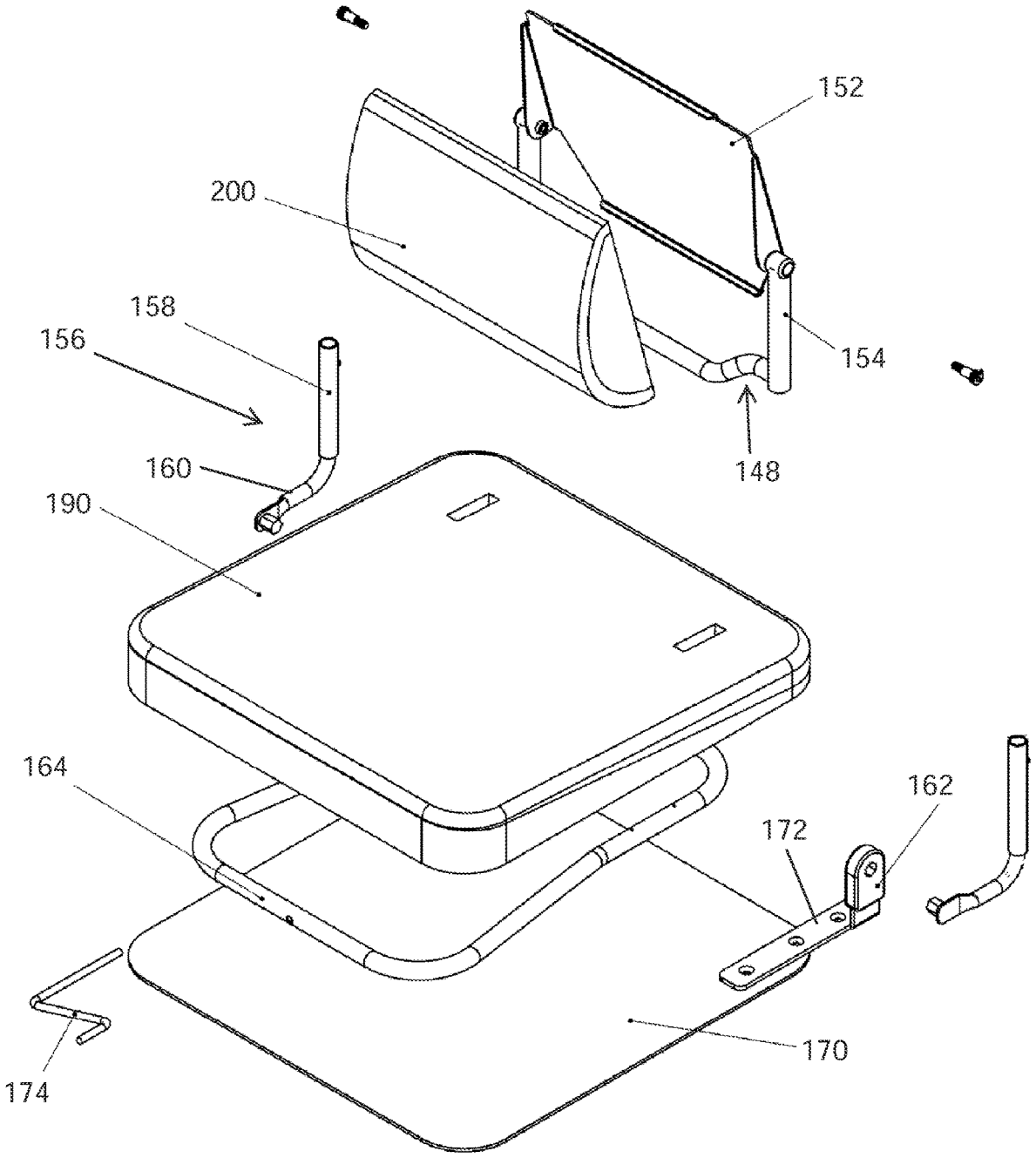
FIG. 17 is an exploded perspective view of the alternative portable lumbar support.
Figure 18A:
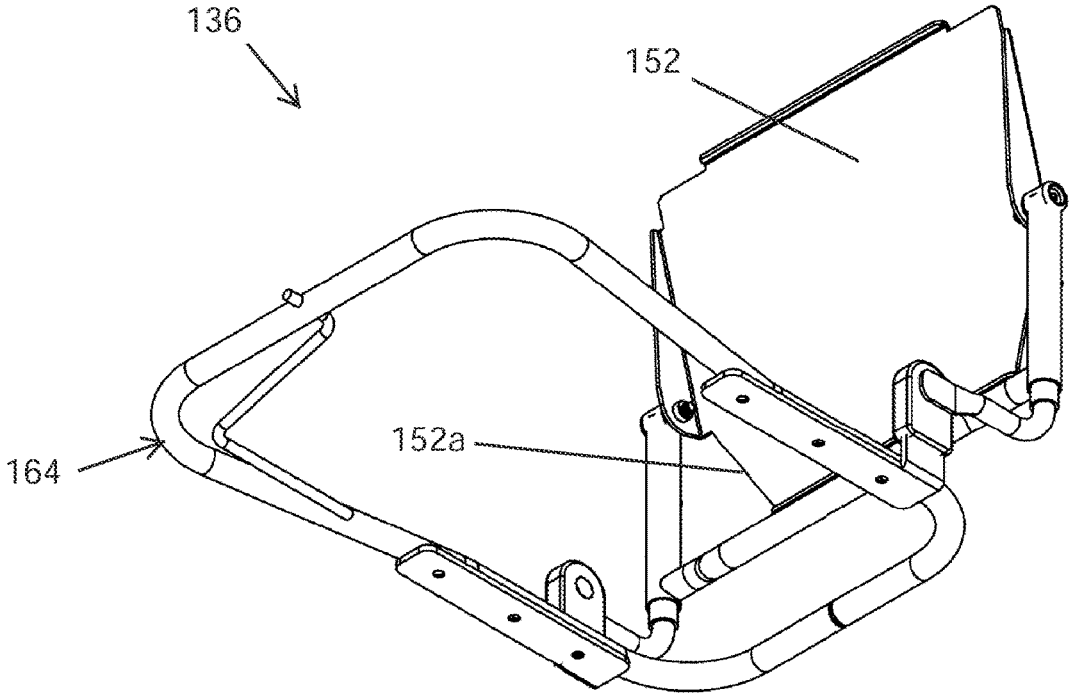
FIGS. 18A and 18B are perspective views of just a frame system of the alternative portable lumbar support, with cushions removed.
Figure 18B:
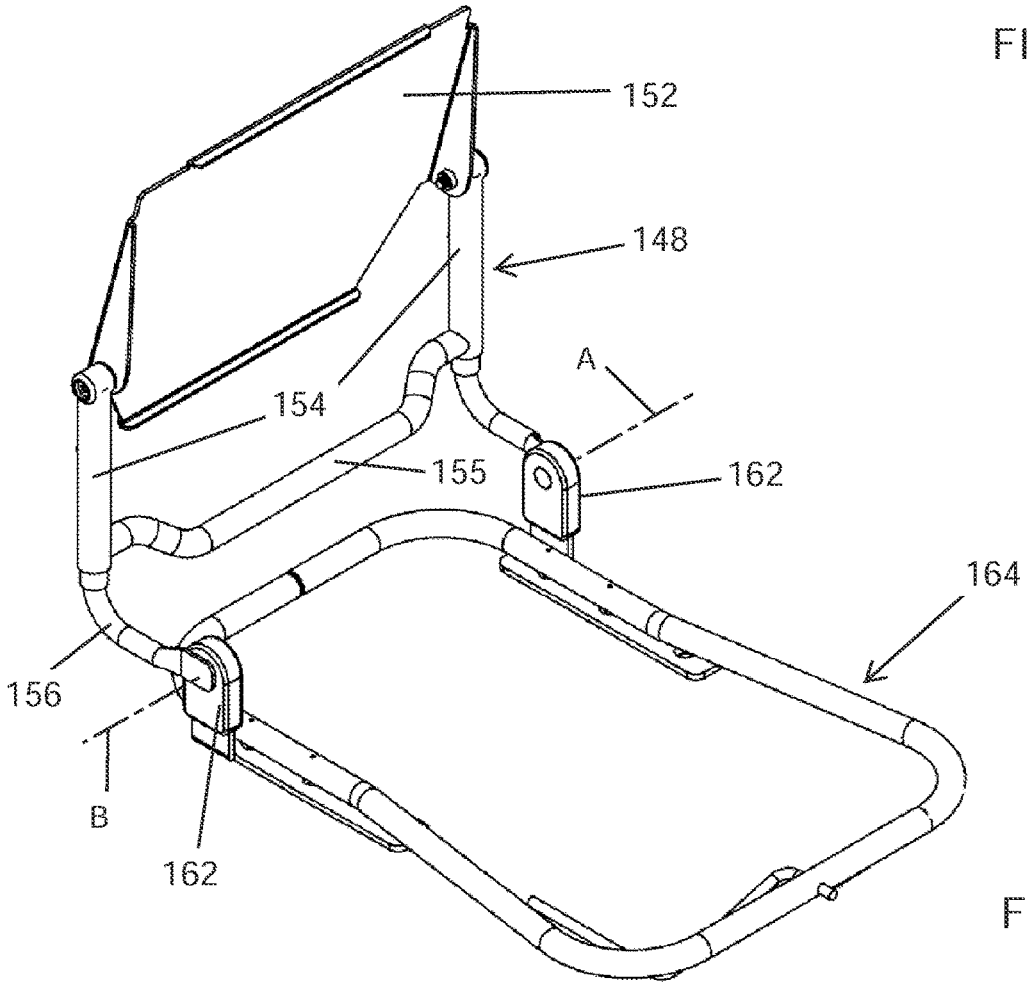

FIG. 17 is an exploded perspective view of the alternative portable lumbar support 120, and FIGS. 18A and 18B are perspective views of just a frame system 136 of the alternative portable lumbar support, with cushions removed. The frame system 136 includes the intermediate frame member 148 which is somewhat U-shaped and pivotally connected to a seat back panel 152 about upper lateral pivot axis A. The intermediate frame member 148 has two laterally spaced tubular struts 154, connected by a horizontal stabilization bar 155, that receive telescopically therein tubular extension struts 158 of two lower rotating members 156. The two lower rotating members 156 each has a rotatable strut 160 arranged to rotate relative to a hinge member 162 about lower lateral pivot axis B. The two hinge members 162, in turn, fasten to outside rear corners of a seat frame 164 to which the cushioned seat 132 is secured. The assembly of the seat back panel 152, intermediate frame member 148, and lower rotating members 156 and their engaging hardware are collectively termed the back support portion 150, which may be rotated together relative to the seat frame 164 about lower lateral axis B. It should be noted from FIGS. 18A and 18B that the seat back panel 152 is substantially rectangular with angled cutouts or reliefs 152*a* at the two lower corners. The reliefs 152*a* help prevent pinching or entrapment of a user's hands or arms between the pivoting seat back panel 152 and the intermediate frame member 148.

FIG. 17 shows a lower base plate 170 on which the seat frame 164 may be secured. Side tubes of the seat frame 164 are secured between the base plate 170 and flat elongated braces 172 to which the hinge member 162 are fastened, as seen in FIGS. 18A and 18B. The base plate 170 is sized and shaped the same as a seat cushion 190, which has a recess on a bottom side (not shown) to receive the seat frame 164. The two hinge members 162 project upward through two slits formed in the seat cushion 190, as seen in FIG. 16. The base plate 170 is then secured to the underside of the seat cushion 190 with fasteners or adhesive to form a flat undersurface. In this way, the seat frame 164 and its tubes is hidden. A stadium hook 174 may also be provided at the front. Alternatively, lower base plate 170 may be simply a thin piece of EVA foam that sits on the bottom of the lumbar support 120 to protect any chair it sits on.

Figure 22A:
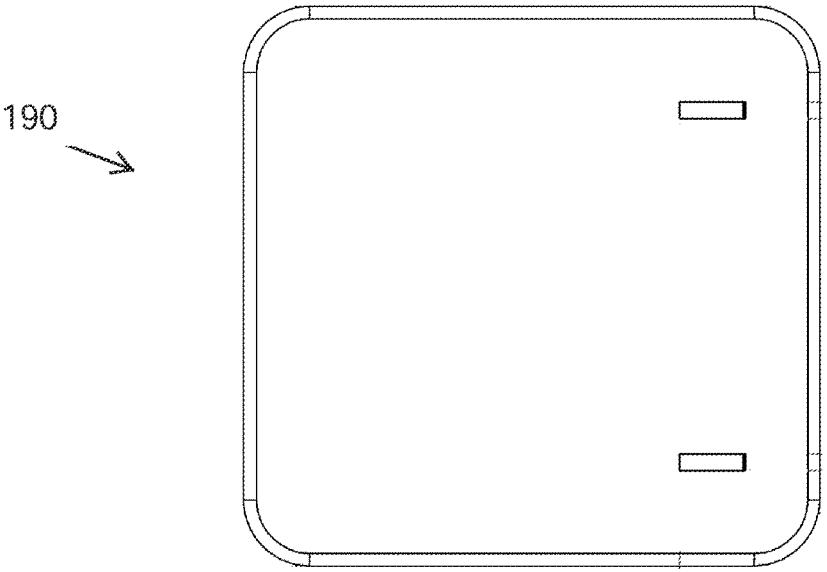
FIGS. 22A and 22B are top plan and side elevational views of a seat cushion of the alternative portable lumbar support.
Figure 22B:
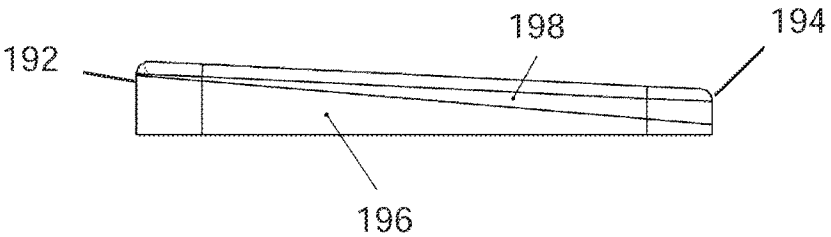

As seen in FIGS. 17 and 22A-22B, the seat 132 has the foam seat cushion (foundation member) 190 as part of the seat 32 that the user sits on. The front edge 192 of the cushion 190 is near the user's knees while the rear edge 194 is near the user's buttocks. The front edge 192 of the foam cushion 190 is taller than the rear edge 194 of the cushion. This angle tilts the user backwards and stops the user from slouching/leaning and sliding forward on the seat. The foam within the cushion 190 may be denser in the front 192 than it is in the rear 194 in order to prevent the user from slouching/leaning and sliding forward in their seat. Preferably, as shown, a lower base foam 196 is denser than an upper surface foam layer 198, with both being wedge-shaped in side view.

Figure 21:
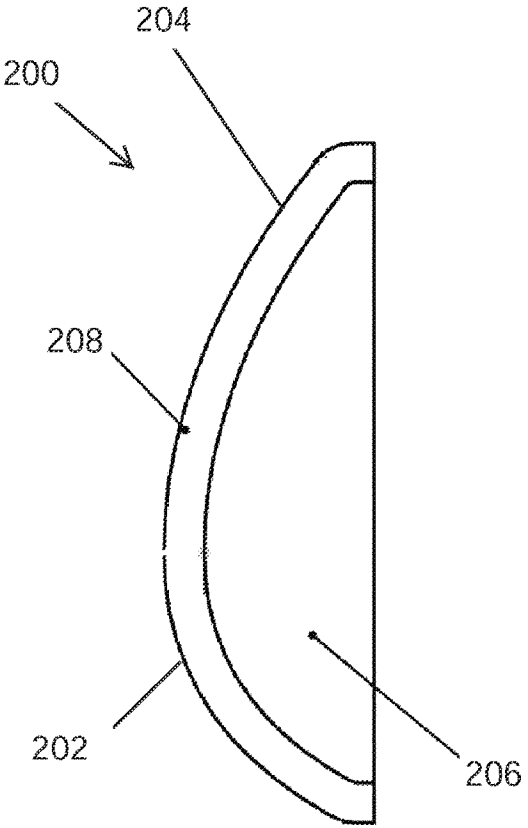
FIG. 21 is a side elevational view of the back cushion of the alternative portable lumbar support.
Figure 23A:
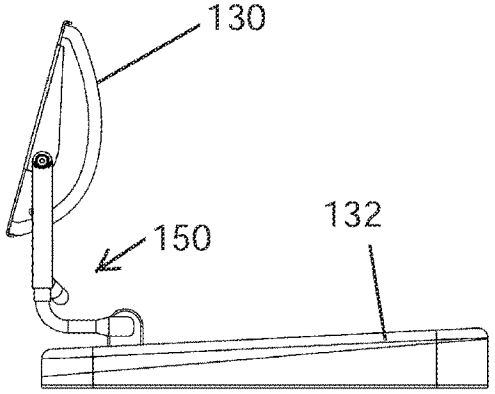
FIGS. 23A-23C are side elevational views of the alternative portable lumbar support in a first configuration with a back support portion shown upright and the seat back shown at different pivot angles.
Figure 23B:
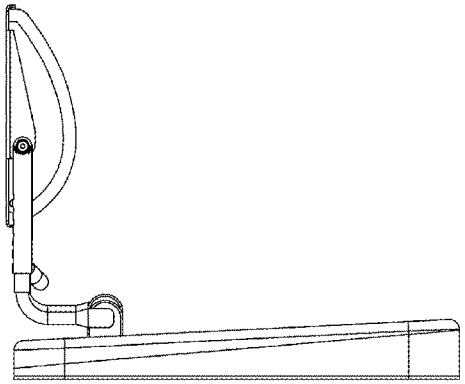
Figure 23C:
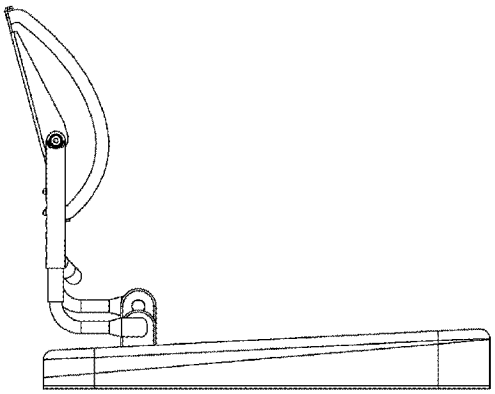
Figure 24A:
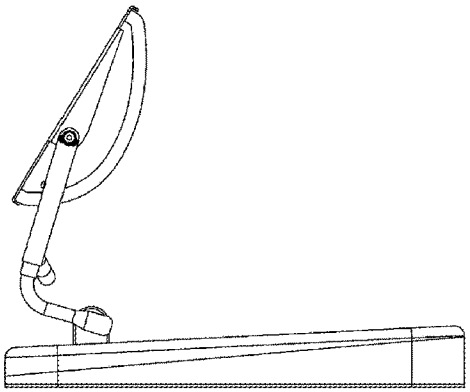
FIGS. 24A-24C are side elevational views of the portable lumbar support with the back support portion shown at different rotational angles and the seat back shown at different pivot angles.
Figure 24B:
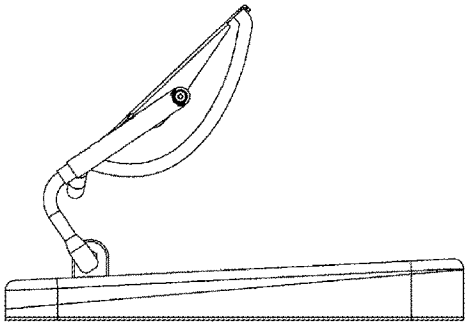
Figure 24C:
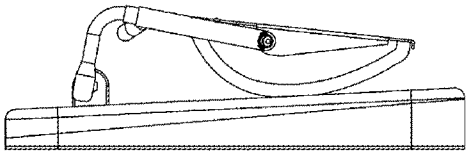

As seen in FIG. 17, the front of the rectangular seat back panel 152 has a foam lumbar support cushion 200 attached to it, whose shape in profile is seen in FIG. 21. The foam lumbar support cushion 200 is convex and elliptical in shape in order to the match to the user's lumbar lordotic curve (lower back) which is concave. The shape of the front of the support cushion 200 is actually like a teardrop, with a greater arc/curvature in a bottom region 202 than in a top region 204 which is less curved. This allows the user to match the part of the arc/curvature of the foam lumbar support cushion 200 with their own unique arc/curvature of their lumbar spine. The lumbar support foam may be either open or closed cell foam. Denser open cell foam or closed cell foam may be used for spinal mobilization and curve correction of the lumbar spine while slightly less dense open cell foam may be used for lumbar support. In a preferred embodiment, as shown, an inner foam 206 is denser than an outer foam layer 208.

Figure 19B:
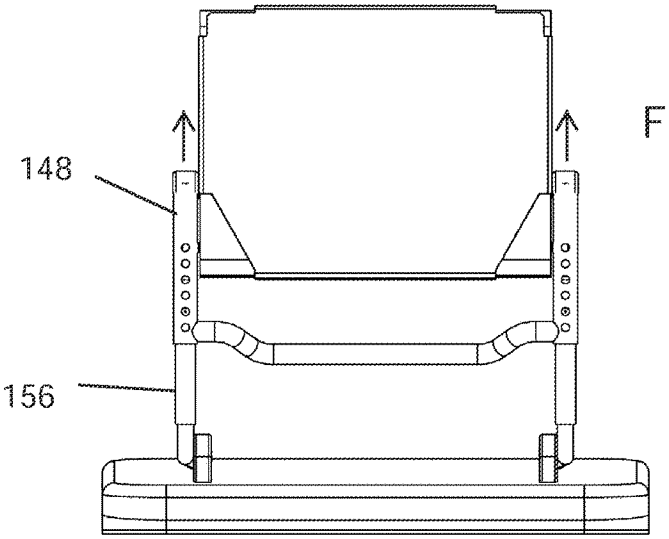
FIG. 19B is a back elevational view of the portable lumbar support in another mode of operation wherein an intermediate frame member has been raised relative to a lower rotating member.
Figure 19A:
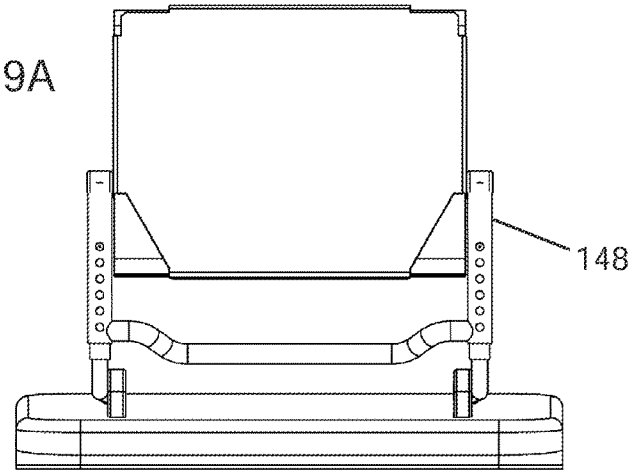
FIG. 19A is a back elevational view of the alternative portable lumbar support in one mode of operation.

FIG. 19A is a back elevational view of the alternative portable lumbar support in one mode of operation, and FIG. 19B is a back elevational view of the portable lumbar support in another mode of operation wherein an intermediate frame member 148 has been raised relative to a lower rotating members 156. This provides the ability to raise and lower the upper lateral pivot axis A relative to the lower lateral pivot axis B.

Figure 20A:
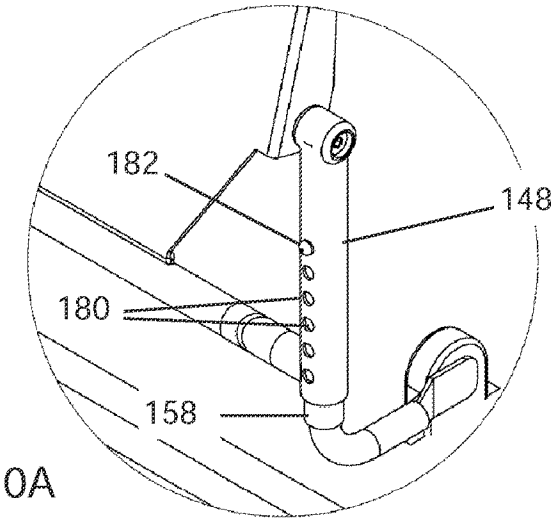
FIG. 20A is an enlargement of a portion of the frame system of FIG. 20.
Figure 20:
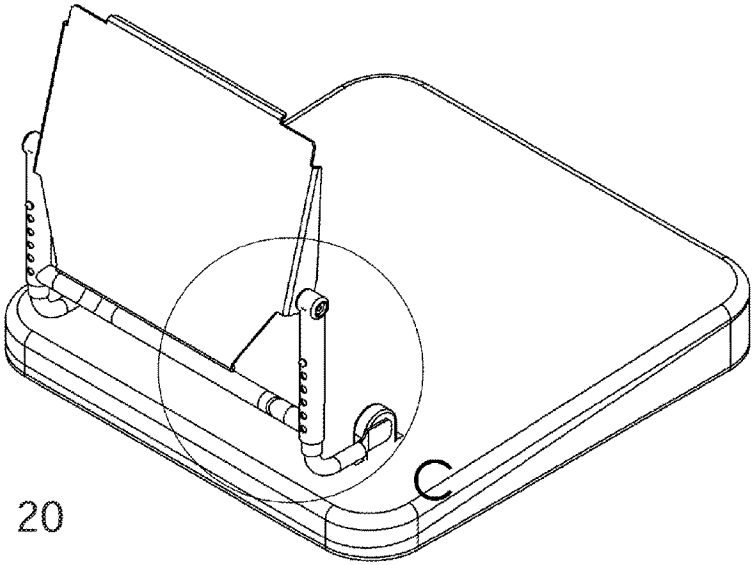
FIG. 20 is a rear perspective view of the alternative portable lumbar support with a back cushion removed.

FIG. 20 is a rear perspective view of the alternative portable lumbar support 20 with a back cushion removed, and FIG. 20A is an enlargement of a portion of the frame system 136. The tubular extension struts 158 of the two lower rotating members 156 fit telescopically within the tubular struts 154 of the intermediate frame member 148. Holes 180 in the tubular struts 154 receive a spring-loaded pin 182 to enable relative changes in height.

Most of the population will lose their lumbar curve over time due to poor posture. With this device the user may experience lumbar curve remodeling over time.

Once the height and the proper lumbar curve have been matched, the user can now increase the amount of lumbar support.

The user leans forward while pulling the lumbar support frame forward with them which will ratchet the gears in a forward direction. Once the user finds their desirable amount of lumbar support, they no longer need to pull it forward as they will now be locked into place with the desired amount of lumbar support. If more support is still desired, they can then pull it forward even more.

By the device pushing the user forward and upright their head will now be over their torso and torso over pelvis, thus improving their posture and creating less slouching.

The lumbar support frame swivels forward and backward around the central, horizontal axis. This allows for constant contact of the lumbar support with the user's lumbar spine thus maintaining a proper lumbar curve even while leaning forward.

Lumbar spinal joint mobilization may occur when the user actively and gently extends backwards and oscillates upon the lumbar support. This may create movement of the lumbar spinal segments and improve range of motion of the lower back, thus achieving a therapeutic effect.

If the user wants to reposition the lumbar support so they have less support they will need to stand up and fully collapse the device forward so the ratchet can be released and then fully open it again to the starting point. Now the user can sit down again and then pull the lumbar support forward to the desired position.

In the collapsed position the portable unit may be carried by the horizontal stabilization bar 55, 155, stored or shipped.

There is a "L" shaped stadium catch or hook on the bottom to hook onto benches that do not have backing so that the user does not lean backwards and fall back.

Although the invention has been described and illustrated with a certain degree of particularity, it is understood that the present disclosure has been made only by way of example, and that numerous changes in the combination and arrangement of parts can be resorted to by those skilled in the art without departing from the scope of the invention, as hereinafter claimed.

What is claimed is:

1. A lumbar support, comprising:

a seat having a seat frame and a seat cushion supported thereby;

a seat back having a rigid seat back panel and a lumbar support seat back cushion supported thereby, wherein looking from a lateral side thereof a front surface of the lumbar support seat back cushion has a convex curvature;

a rigid back support portion including the seat back panel connected to an intermediate frame member which is in turn connected to a pair of laterally-spaced rotating members, the rotating members being coupled to hinges defining a lower lateral axis fixed with respect to the seat frame to enable rotation of the back support portion around the fixed lower lateral axis, wherein the seat back is coupled to the intermediate frame member to freely pivot around an upper lateral axis, wherein the rigid back support portion is positionally adjustable to space the seat back toward and away from the hinges and enable raising or lowering the upper lateral axis and thus the seat back with respect to the lower lateral axis; and wherein the hinges include a ratcheting mechanism with gears that ratchet when rotating the back support portion in a forward direction around the lower lateral axis and prevent the seat back from rotating backwards in the opposite direction, wherein the hinges may be released to enable rotation of the back support portion backwards only upon full forward rotation to a collapsed position.

2. The lumbar support of claim 1, wherein looking from a lateral side thereof the front surface of the lumbar support seat back cushion has a teardrop shape with a greater arc/curvature in a bottom region than in a top region which is less curved so as to match the arc/curvature of a lumbar lordotic curve of a user sitting on the seat.

3. The lumbar support of claim 2, wherein the seat cushion has a front edge taller than a rear edge so as to have an upper surface angled down toward the rear edge.

4. The lumbar support of claim 1, wherein the seat back is coupled to the intermediate frame member using spring-loaded pins through coupling bores on both lateral sides of the intermediate frame member that define the upper lateral axis, the spring-loaded pins extending inward into one of a series of receiving holes on each side of the seat back panel for positional adjustment of the seat back panel relative to the coupling bores and upper lateral axis.

5. The lumbar support of claim 1, wherein the seat back is coupled to the intermediate frame member such that the upper lateral axis is positionally adjustable along the intermediate frame member toward and away from the hinges, and the intermediate frame member is connected to the laterally-spaced rotating members so as to be positionally adjustable toward and away from the hinges to enable raising or lowering the upper lateral axis and thus the seat back with respect to the lower lateral axis in two ways.

6. The lumbar support of claim 5, wherein the seat back is coupled to the intermediate frame member using spring-loaded pins through coupling bores on both lateral sides of the intermediate frame member that define the upper lateral axis, the spring-loaded pins extending inward into one of a series of receiving holes on each side of the seat back panel for positional adjustment of the seat back panel relative to the coupling bores and upper lateral axis.

7. The lumbar support of claim 1, wherein the lumbar support has no legs and is configured to be positioned on a chair, bleacher or bench, and the seat frame has a stadium seat hook rotatably connected at a front end thereof for securing the lumbar support to the chair, bleacher or bench.

8. A lumbar support, comprising:

a seat having a seat frame and a seat cushion supported thereby;

a seat back having a rigid seat back panel and a lumbar support seat back cushion supported thereby, wherein looking from a lateral side thereof a front surface of the lumbar support seat back cushion has a convex curvature;

a rigid back support portion including the seat back panel connected to an intermediate frame member which is in turn connected to a pair of laterally-spaced rotating members each having a tubular extension strut, wherein the intermediate frame member is U-shaped with two laterally-spaced tubular struts connected by a lateral stabilization bar and the tubular struts couple telescopically with tubular extension struts of the rotating members so as to be positionally adjustable, wherein the seat back is coupled to the intermediate frame member to freely pivot around an upper lateral axis, and wherein the rotating members are coupled to hinges defining a lower lateral axis fixed with respect to the seat frame to enable rotation of the back support portion around the fixed lower lateral axis, wherein the upper lateral axis is positionally adjustable along the intermediate frame member toward and away from the hinges, and the intermediate frame member is positionally adjustable along the tubular extension struts toward and away from the hinges to enable raising or lowering the upper lateral axis and thus the seat back with respect to the lower lateral axis in two ways.

9. The lumbar support of claim 8, wherein looking from a lateral side thereof the front surface of the lumbar support seat back cushion has a teardrop shape with a greater arc/curvature in a bottom region than in a top region which is less curved so as to match the arc/curvature of a lumbar lordotic curve of a user sitting on the seat.

10. The lumbar support of claim 9, wherein the seat cushion has a front edge taller than a rear edge so as to have an upper surface angled down toward the rear edge.

11. The lumbar support of claim 8, wherein the seat back is coupled to the intermediate frame member using spring-loaded pins through coupling bores on both lateral tubular struts of the intermediate frame member that define the upper lateral axis, the spring-loaded pins extending inward into one of a series of receiving holes on each side of the seat back panel for positional adjustment of the seat back panel relative to the coupling bores and upper lateral axis.

12. The lumbar support of claim 1, wherein the lumbar support has no legs and is configured to be positioned on a chair, bleacher or bench, and the seat frame has a stadium seat hook rotatably connected at a front end thereof for securing the lumbar support to the chair, bleacher or bench.

13. A lumbar support, comprising:

a seat having a seat frame and a seat cushion supported thereby, wherein the seat cushion has a front edge taller than a rear edge so as to have an upper surface angled down toward the rear edge;

a seat back having a rigid seat back panel and a lumbar support seat back cushion supported thereby, wherein looking from a lateral side thereof a front surface of the lumbar support seat back cushion has a convex curvature, and the seat back cushion is formed of two types of foam, a first denser foam covered by a second less dense foam;

a rigid back support portion including the seat back panel connected to an intermediate frame member which is in turn connected to a pair of laterally-spaced rotating members, the rotating members being coupled to hinges defining a lower lateral axis fixed with respect to the seat frame to enable rotation of the back support portion around the fixed lower lateral axis, wherein the seat back is coupled to the intermediate frame member to freely pivot around an upper lateral axis, wherein the rigid back support portion is positionally adjustable to space the seat back toward and away from the hinges and enable raising or lowering the upper lateral axis and thus the seat back with respect to the lower lateral axis; and wherein the hinges include a mechanism that enables indexed rotation between a series of incremental rotational positions.

14. The lumbar support of claim 13, wherein the seat back is coupled to the intermediate frame member using spring-loaded pins through coupling bores on both lateral sides of the intermediate frame member that define the upper lateral axis, the spring-loaded pins extending inward into one of a series of receiving holes on each side of the seat back panel for positional adjustment of the seat back panel relative to the coupling bores and upper lateral axis.

15. The lumbar support of claim 13, wherein the seat back is coupled to the intermediate frame member such that the upper lateral axis is positionally adjustable along the intermediate frame member toward and away from the hinges, and the intermediate frame member is connected to the laterally-spaced rotating members so as to be positionally adjustable toward and away from the hinges to enable raising or lowering the upper lateral axis and thus the seat back with respect to the lower lateral axis in two ways.

16. The lumbar support of claim 15, wherein the seat back is coupled to the intermediate frame member using spring-loaded pins through coupling bores on both lateral sides of the intermediate frame member that define the upper lateral axis, the spring-loaded pins extending inward into one of a series of receiving holes on each side of the seat back panel for positional adjustment of the seat back panel relative to the coupling bores and upper lateral axis.

17. The lumbar support of claim 15, wherein the intermediate frame member is U-shaped with two laterally-spaced tubular struts connected by a lateral stabilization bar, wherein the tubular struts couple telescopically with tubular extension struts of the rotating members so as to be linearly adjustable.

18. The lumbar support of claim 17, wherein the seat frame has a stadium seat hook rotatably connected at a front end thereof for securing the lumbar support to the chair, bleacher or bench.

19. The lumbar support of claim 17, further including spring-loaded buttons that engage longitudinally-spaced holes between the tubular struts and tubular extension struts which enable incremental linear adjustment therebetween.

20. The lumbar support of claim 13, wherein the lumbar support has no legs and is configured to be positioned on a chair, bleacher or bench.

* * * * *